US010195508B2

(12) United States Patent
Rigoli

(10) Patent No.: US 10,195,508 B2
(45) Date of Patent: Feb. 5, 2019

(54) DUAL BRACKET MECHANISM MOUNTED SPORTS GOAL PRACTICE BACKSTOP SYSTEM

(71) Applicant: Smart Sports Tek, Inc., Wrentham, MA (US)

(72) Inventor: Michael Rigoli, Wrentham, MA (US)

(73) Assignee: Smart Sports Tek, Inc., Wrentham, MA (US)

( * ) Notice: Subject to any disclaimer, the term of this patent is extended or adjusted under 35 U.S.C. 154(b) by 0 days.

(21) Appl. No.: 15/388,949

(22) Filed: Dec. 22, 2016

(65) Prior Publication Data

US 2017/0173431 A1 Jun. 22, 2017

Related U.S. Application Data

(60) Provisional application No. 62/270,972, filed on Dec. 22, 2015.

(51) Int. Cl.

| | |
|---|---|
| ***A63B 63/00*** | (2006.01) |
| ***A63B 69/00*** | (2006.01) |
| ***A63B 71/02*** | (2006.01) |
| *A63B 102/24* | (2015.01) |
| *A63B 102/14* | (2015.01) |
| *A63B 102/22* | (2015.01) |

(52) U.S. Cl.

CPC ..... *A63B 69/0024* (2013.01); *A63B 63/004* (2013.01); *A63B 71/022* (2013.01); *A63B 2071/026* (2013.01); *A63B 2102/14* (2015.10); *A63B 2102/22* (2015.10); *A63B 2102/24* (2015.10); *A63B 2208/0204* (2013.01); *A63B 2209/08* (2013.01); *A63B 2209/10* (2013.01); *A63B 2210/50* (2013.01); *A63B 2243/0025* (2013.01)

(58) Field of Classification Search

CPC ..... A63B 69/0024; A63B 2208/0204; A63B 71/022; A63B 63/004; A63B 2210/50; A63B 69/0071

USPC ..... 473/435, 433, 479, 487, 434, 422, 476, 473/446, 481, 197, 421; D21/698–705; 273/400

See application file for complete search history.

(56) References Cited

U.S. PATENT DOCUMENTS 3,408,071 A * 10/1968 Lundy ..... A63B 71/022 473/421
3,901,506 A * 8/1975 Caveney ..... A63B 63/083 473/433
4,072,295 A * 2/1978 Roberts ..... A63B 71/022 473/421
4,723,780 A * 2/1988 Vinzetta ..... A63B 63/00 473/197
5,129,648 A * 7/1992 Sweeney ..... A63B 63/083 473/433

(Continued)

*Primary Examiner* — Mitra Aryanpour
(74) *Attorney, Agent, or Firm* — Bay State IP, LLC

(57) ABSTRACT

A sports goal practice backstop for removable attachment to a sports goal, sans any kind of tools, including a backstop net mechanism with a multiplicity of sections, a right and left bracket assembly including a corner bracket mechanism with a clamp knob and a pivot hinge member, a right and left support structures that are removably attached to the pivot hinge members and a counterweight mechanism which counterbalances the weight of the backstop net mechanism.

17 Claims, 48 Drawing Sheets

(56) References Cited

U.S. PATENT DOCUMENTS

| | | | | |
|---|---|---|---|---|
| 5,205,564 | A * | 4/1993 | Lamberti | A63B 63/004 473/421 |
| 5,564,711 | A * | 10/1996 | Scheie | A63B 61/00 273/400 |
| 6,746,348 | B2 * | 6/2004 | Barnes | A63B 63/083 473/431 |
| 6,849,009 | B1 * | 2/2005 | Forlini | A63B 71/022 473/446 |
| 6,899,645 | B1 * | 5/2005 | Hsiao | A63B 63/004 473/477 |
| 7,244,199 | B1 * | 7/2007 | Romano | A63B 71/022 473/446 |
| 7,351,168 | B1 * | 4/2008 | Pannell | A63B 63/004 473/476 |
| 7,963,865 | B2 * | 6/2011 | Rigoli | A63B 71/022 473/478 |
| D649,608 | S * | 11/2011 | Kalas | D21/705 |
| 8,100,784 | B2 * | 1/2012 | Conforti | A63B 71/022 473/478 |
| 8,460,129 | B2 * | 6/2013 | Forlini | A63B 69/0071 473/435 |
| 2007/0158913 | A1 * | 7/2007 | Rigoli | A63B 63/004 273/407 |
| 2009/0069124 | A1 * | 3/2009 | Forlini | A63B 69/0071 473/435 |
| 2010/0069178 | A1 * | 3/2010 | Plut | A63B 63/004 473/435 |

* cited by examiner

DUAL BRACKET MECHANISM MOUNTED SPORTS GOAL PRACTICE BACKSTOP SYSTEM

CROSS REFERENCE TO RELATED APPLICATION

This application claims the benefit of and takes priority from U.S. Provisional Patent Application Ser. No. 62/270,972 filed on Dec. 22, 2016, the contents of which are herein incorporated by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE INVENTION

The present invention relates generally to sporting goods, namely sports goal practice backstops for sports such as, but not limited to, lacrosse, soccer, field hockey and hockey, including improvements to sports goals backstops including a dual bracket mechanism mounted sports goal practice backstop system.

BACKGROUND OF THE INVENTION

Many sports require the use of some type of ball or similar object in order to accomplish the outcome of the game. Sports like lacrosse, soccer, and field hockey all utilize a ball. Hockey utilizes a rubber puck. These sports require a player to participate in the game by "scoring" goals. In other words, a player must successfully get the ball or puck into a goal. A player's skills in accomplishing the scoring feat takes practice and many players spend countless hours practicing scoring and/or shooting at a goal.

A sports goal backstop is often utilized during practice sessions to aid in retaining the ball or playing within the confines of the playing field or practice space. Further, backstops are used in retrieval of shots that miss the desired mark.

The instant backstop is designed to facilitate in the prevention of a wayward shot from traveling beyond the goal and thus eliminate the need for the players to chase the ball or similar object, wasting time. This allows for more efficient practice time, wherein a player is also capable of taking more shots in a set practice session. Further, the sports goal backstop prevents the loss of a ball due to an errant shot.

The sports goal backstop keeps the ball in the general area of where the player is practicing. In particular, the instant backstop may be useful during practice sessions for sports such as, but not limited to, lacrosse and soccer.

Starting at a young age and moving far beyond the polished skills of professional athletes in such sports as lacrosse, hockey, and soccer, players are coached to shoot balls and pucks into locations that are hard to reach by goalies. Players regularly aim to shoot for corners and side gaps of the goal as openings exist therein. These locations tend to be more difficult for the goalie to protect. Thus, players want to perfect their skills to shoot and score successfully in these vulnerable areas.

In some sports, lacrosse in particular, players are coached to take a special type of shot known as "bounce shots." This shot occurs when a player shoots the ball to a spot in the cease area in front of the goalie and the ball bounces from the ground into the upper part of the goal. The fast pace move, if performed successfully, can trick the goalie to leaving the upper part of the goal unprotected. Due to the blind nature of the shot, when taken in conjunction with the level of timing required by a goaltender to defend such shot, defense is normally rendered nearly impossible when placement is correct.

The varying shots discussed above, while tricky to a goaltender in theory, rarely find the proper location in practice and thus, during training when the player actually attempts to execute such complex shots, the object utilized, be it ball or puck, rarely hits the intended target or spot, due mainly to the lack of skill and accuracy required. Therefore, depending on the location of the field, rink, or practice area, and the inherent proximity to wooded areas, houses, and/or automobiles, when shots are missed, the ball may be lost and damage may additionally be incurred by surrounding houses, automobiles, and even people and animals. Further time spent finding and retrieving wild balls takes time away from actual practice and ultimately is wasted time for individuals trying to perfect their shooting.

Wayward balls and similar objects not only cost a player time but actual balls, depending on the area, balls may be lost and never relocated by the player. Consistently having to replace balls can prove costly. Ergo, as for example, lacrosse balls can cost as much as $3.00 per ball, such a level loss on a regular basis may render practicing intricate shots prohibitive from a budgetary standpoint, thus impeding creative playmaking activity. Furthermore, an innocent bystander or personal property may withstand injury or damage from loose, wild balls, taking chances will inherently be discouraged. As a consequence, creativity of the players may be stifled, as well as players may never achieve improvement on their shots and gameplay.

As stated, the most poignant result of wayward balls is the loss of valuable time and efficiency incurred in retrieving these errant balls. Interrupted practice situations can become frustrating, discouraging, and cause players, especially younger players to quickly lose interest and/or practice their shooting drills less.

Current backstop designs in the state of the art today require extensive setup and maintenance, including the possibility of having to drill holes in the goal and utilize tools to assemble and install the system. Currently utilized is a "fence-like" design that is simply a long metal tubular framed net that installs to the ground and is held up by flimsy foot-like base members and stabilizing cables at each end. This type of design is normally constructed behind the goal and is likely permanently secured due to the difficulty in setup, handling, and storage. Thus, this "fence-like" design offers no backstop support for "bounce shots" as described above.

Another design with the current state of the art comprises a "cage" type design, similar to a golf practice apparatus. This design is intended to fully encase the entire goal, but possesses very limited backstop protection from side to side and above the goal standpoints. Additionally, the cage-like design is extremely restrictive when trying to practice shooting on a net at an angle.

One common factor evident in all of the above-discussed designs is a tendency toward apparatuses, which are esthetically unpleasing when located in a user's yard or on a sports field. In addition, many of these systems cannot be easily stored away at the end of practice and thus must be left around. Further, these designs also take up massive amounts of storage space—space that may not be readily available for all players—which renders these designs as eyesores and also creates the opportunity for the systems to be damaged or stolen.

In other designs, a sports goal backstop includes a backstop, which is statically attached to a practice goal, used in lieu of the goal. In such a formation, the sports goal backstop/practice goal unit must be transported to the field, set up for practice, and then transported from the field. Additionally, great modification may be required, again including the possibility of having to drill holes in the goal and utilize tools to assemble and install the system. This procedure is not only cumbersome, but also time consuming.

In other instances, the sports goal backstop is a removable backstop that can be used along with the goal. In this instance, the sports goal backstop must still be transported to the field, set up for practice, and then transported from the field. As a result, this procedure is cumbersome and time consuming as well.

SUMMARY OF THE INVENTION

The instant invention, as illustrated herein, is clearly not anticipated, rendered obvious, or even present in any of the prior art mechanisms, either alone or in any combination thereof. The versatile system, method, and series of apparatuses for creating and utilizing a system for a dual bracket mounted sports goal practice backstop are illustrated. Thus the several embodiments of the instant apparatus are illustrated herein.

It is therefore an object of the present system to provide a dual bracket mechanism mounted sports goal practice backstop which does not require the drilling of apertures or holes in the goal frame and additionally does not require the utilization of tools to assemble and install the system.

It is therefore an object of the present system to provide a dual bracket mechanism mounted sports goal practice backstop with an automated design featuring retractable actuation handles which can be fully integrated to the profile of an existing goal, thus allowing the backstop to remain in place during game time if desired.

It is yet another object of the present invention to provide a dual bracket mechanism mounted sports goal practice backstop that may be attached to any goal and remain in place, if desired, at the conclusion of practice and during games. During practice, the sports goal backstop of the present invention provides a suitable backstop to stop most balls or similar objects from traveling beyond the goal. Further, the instant backstop also features easy attachment and removal with dual bracket mechanisms. The system may be readily broken down and removed for game time if desired, without the need for utilization of any tools whatsoever. At the conclusion of practice, the sports goal backstop of the present invention is foldable such that it need not be totally removed at the conclusion of each practice. The sports goal backstop of the present invention may remain in position, out of sight, in its folded configuration during a game with minimal to no interference with normal play.

It is yet another object of the present invention to provide a dual bracket mechanism mounted sports goal practice backstop that is easy to assemble (without the need for usage of any tools), lightweight, and compact. The system weighs very little, fits goals of all pipe diameters and goal widths, is easy to set up and install and may fit, but is not limited to a configuration such as a 60 inch×10 inch×8 inch box or in a travel bag or other duffle bag mechanism.

Additionally, the instant system provides coverage only around the area of the goal that is functional, the front face of the entire goal and also allows the player to stow the backstop netting behind the goal in a non-functional area so that the goal can be practiced on without the interference of a backstop. The benefit of this design is that the player can easily deploy the backstop for practice and then quickly stow it away for game-like shooting and scrimmages.

Once the current sports goal practice backstop is installed it requires only one person to deploy and stow the system. The system operates from either side of the goal and functions with a simple bracket mechanism and pivot hinge member. The operator simply attaches the bracket mechanism to the goal post using the clamp knobs (sans any tools) to secure the bracket mechanism to the goal post. Then, the operator simply lifts the pivot hinge member into position to release it from the stored position.

The user then activates and lifts the backstop into the locked position. When the operator locks the pivot hinge member, pulls the side nets to deploy the outer net poles and the sports goal practice backstop is ready to use. This procedure is repeating in reverse to stow away the backstop. The backstop remains stable during deployment due to the counterbalance weight system installed on the rear section of the goal.

It is yet another object of the present invention to provide a backstop design that offers shot protection from all angles including the top due to its innovative forward angular design on all three sides. The top angle design allows the player to take bounce shots with a high probability of stopping it in the event that it misses the intended target. The corner and side gap shorts are supported by the forward angular side design. If the player wishes to practice sharp angle shots from either side, the player simply folds the shooting side net wing back onto the goal, leaving the rest of the system intact and functioning, thus allowing the player to shoot without interference from the backstop on that given side.

It is yet another object of the present invention to provide a sports goal backstop to support practice sessions, which can be installed and removed with ease and yet operated via a dual bracket mechanism system. It is a further object of the present invention to provide a sports goal practice backstop that need not be removed from the field in order to ready the field for game play, however, the sports goal practice backstop can be easily removed if needed.

It is a further objective of the instant invention to provide a sports goal practice backstop that securely attaches to a goal and is foldable such that it is out of sight and does not obstruct normal play of the desired sport. It is an even further object of the instant invention to provide an automated system which can be transported to and from the practice field in a singly container and which can be transported by a sole individual.

The size and orientation of the open or deployed back stop mimics the approximate diameter of the actual goal crease. This orientation provides the user with a frame of reference on the field of play with regard to the user's proximity to the goal crease. In doing so, the system allows the user to practice conforming to the standard game regulations for non-entry into the crease from behind the opponents net, which pertains specifically to lacrosse.

In addition, it is yet another object of the instant invention to provide a practice net system that can be cleanly and quickly removed from a standard goal net by utilizing both a bracket mechanism and a pivot hinge member with net support poles, which anchor the system and also make it easy to break down by one individual, with no tools required.

Additionally, in another embodiment, it is an objective of the instant invention to allow easy Pivot hinge member replacement by use of clamp mechanisms that are removable and reusable.

Another objective of the instant invention is to provide additional reinforcement and support to the outside of the pivot hinge member socket by adding additional strength by use of the clamp apparatuses.

It is an additional objective of the instant invention to comprise a groove on the outer portion of the boot wrap apparatuses to communicate with the clamp mechanism for the purpose of maintaining its location as well as being deep enough to imbed the clamp mechanism.

Finally, it is an object of the present invention to provide an automated sports goal practice backstop that securely attaches to a goal and is foldable such that it is out of sight and does not obstruct normal play.

Accordingly, a dual bracket mechanism mounted sports goal practice backstop and accompanying enhancements its component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the dual bracket mechanism mounted sports goal practice backstop in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

DETAILED DESCRIPTION OF THE SEVERAL EMBODIMENTS

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as flywheel systems with magnetic bearings used in a variety of applications.

Referring now to the figures to better illustrate the present invention, in FIGS. 1-6, there is shown, at different angles, one embodiment of a sports goal practice backstop 10, as configured to attach to a lacrosse goal. Further, FIGS. 1-6 illustrate the sports goal practice backstop 10 in a preferred embodiment as attached to a lacrosse net.

Figure 1:
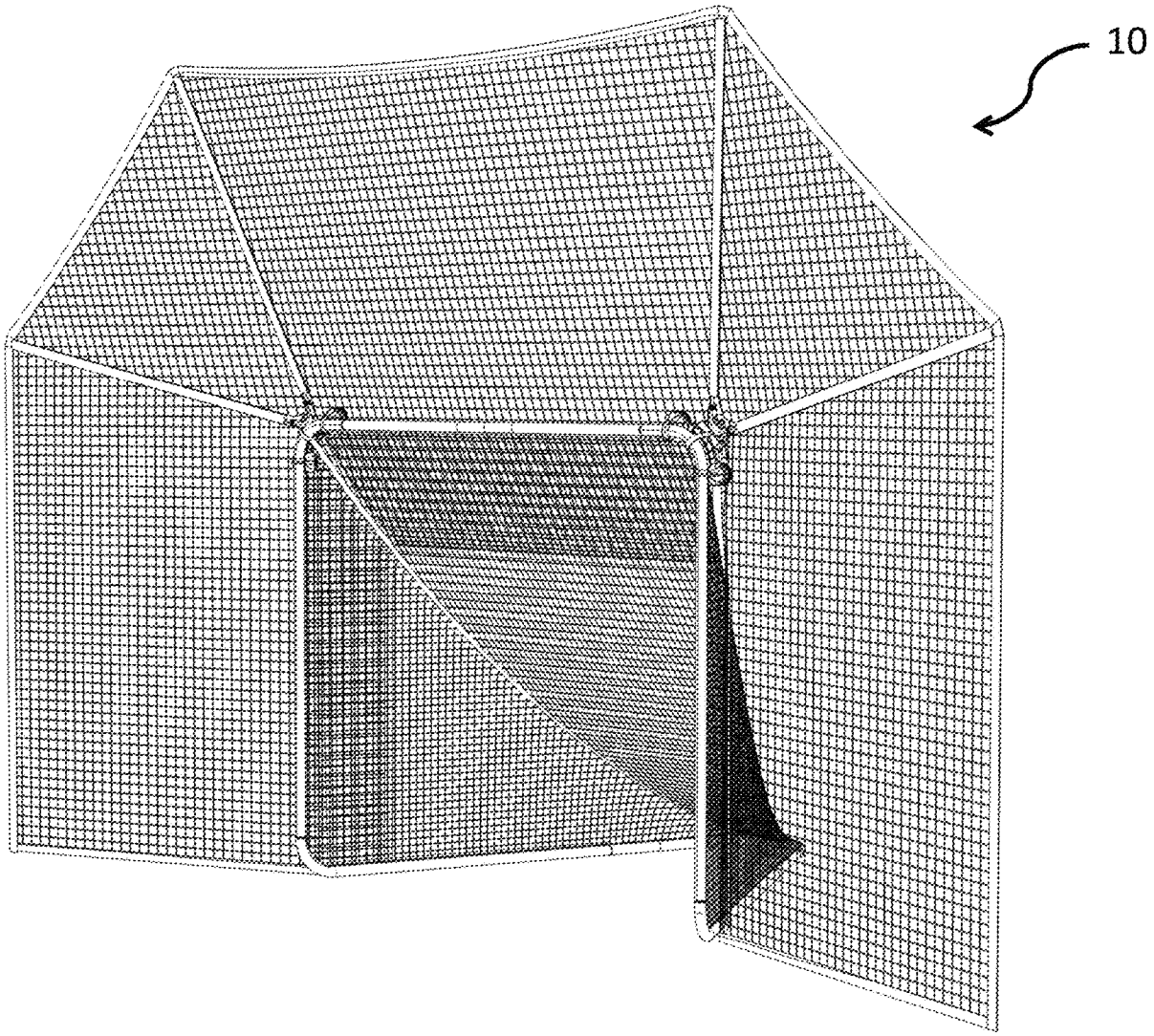
FIG. 1 illustrates a perspective front view of the dual bracket mechanism mounted sports goal practice backstop of the instant invention, attached to an existing goal and fully assembled and raised.
Figure 2:
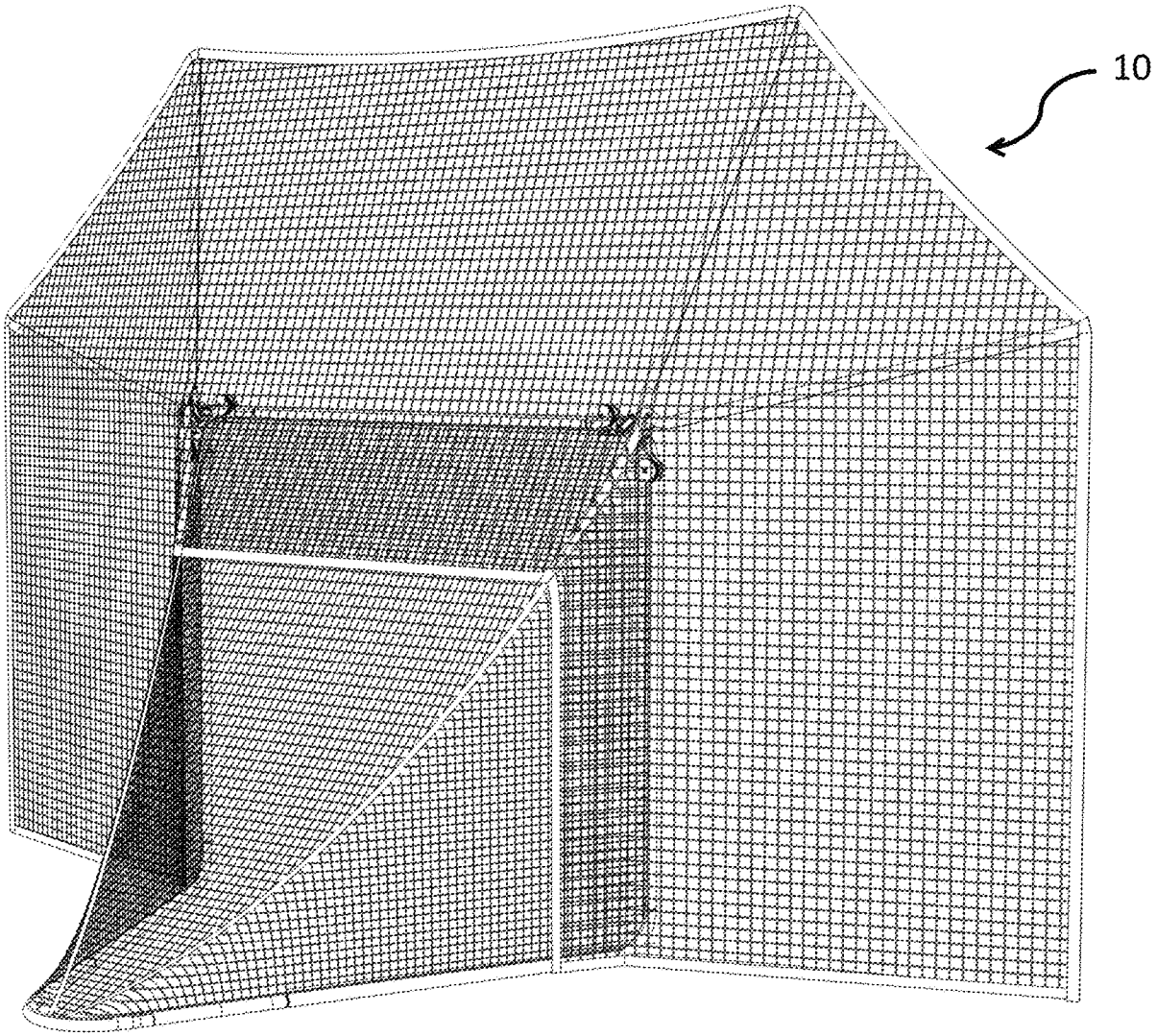
FIG. 2 illustrates a perspective back view of the dual bracket mechanism mounted sports goal practice backstop of the instant invention, attached to an existing goal and fully assembled and raised.
Figure 3:
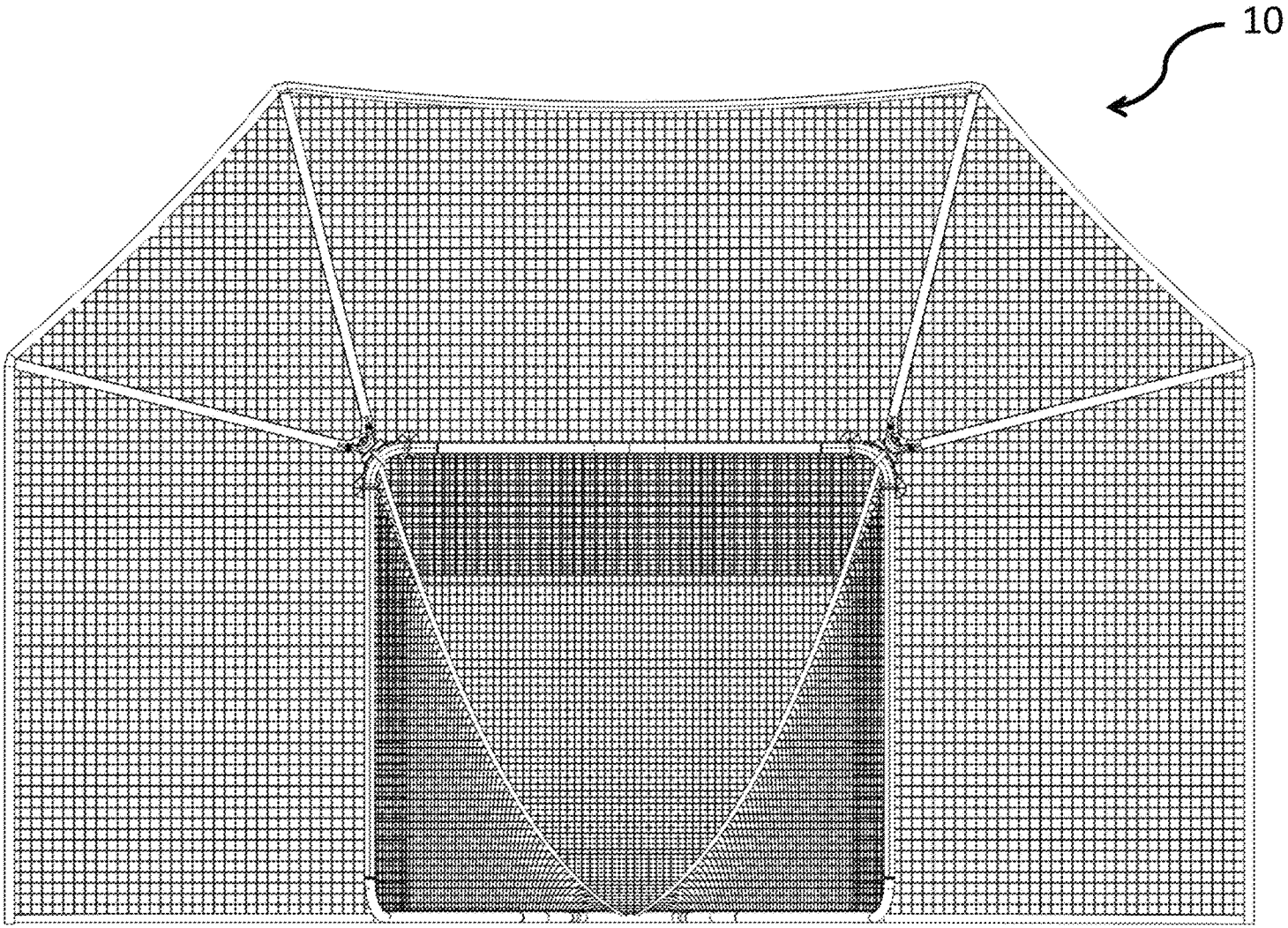
FIG. 3 illustrates a front view of the dual bracket mechanism mounted sports goal practice backstop of the instant invention, attached to an existing goal and fully assembled and raised.
Figure 4:
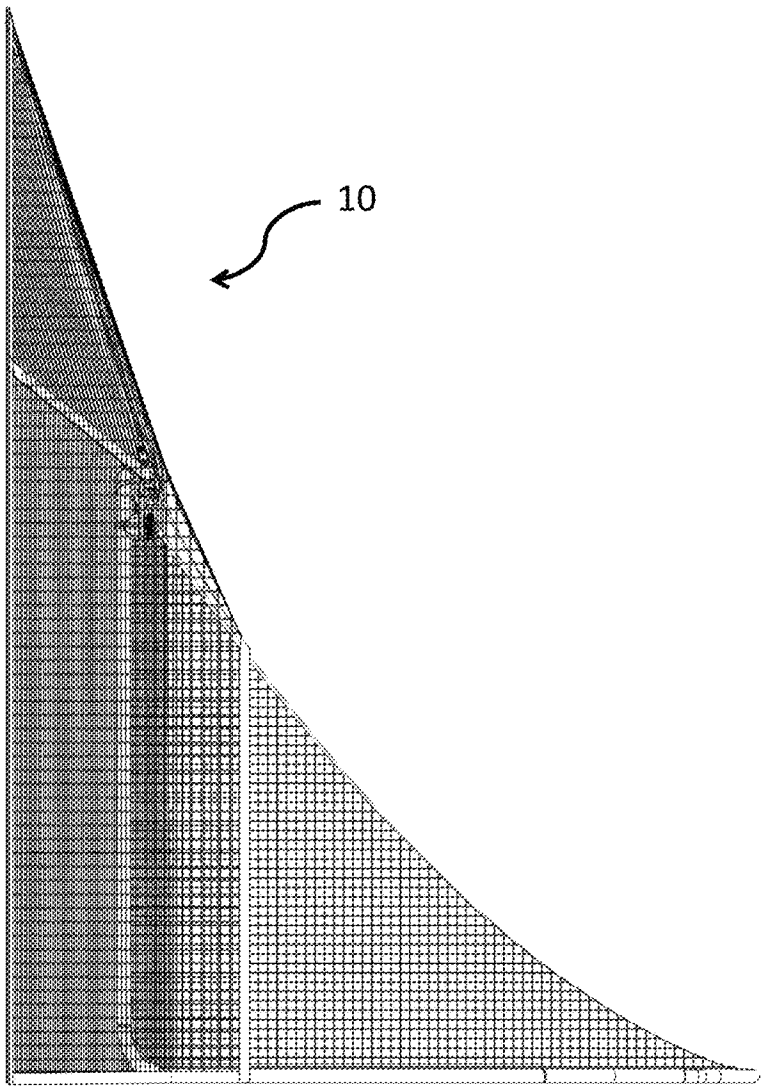
FIG. 4 illustrates a side view of the dual bracket mechanism mounted sports goal practice backstop of the instant invention, attached to an existing goal and fully assembled and raised.
Figure 5:
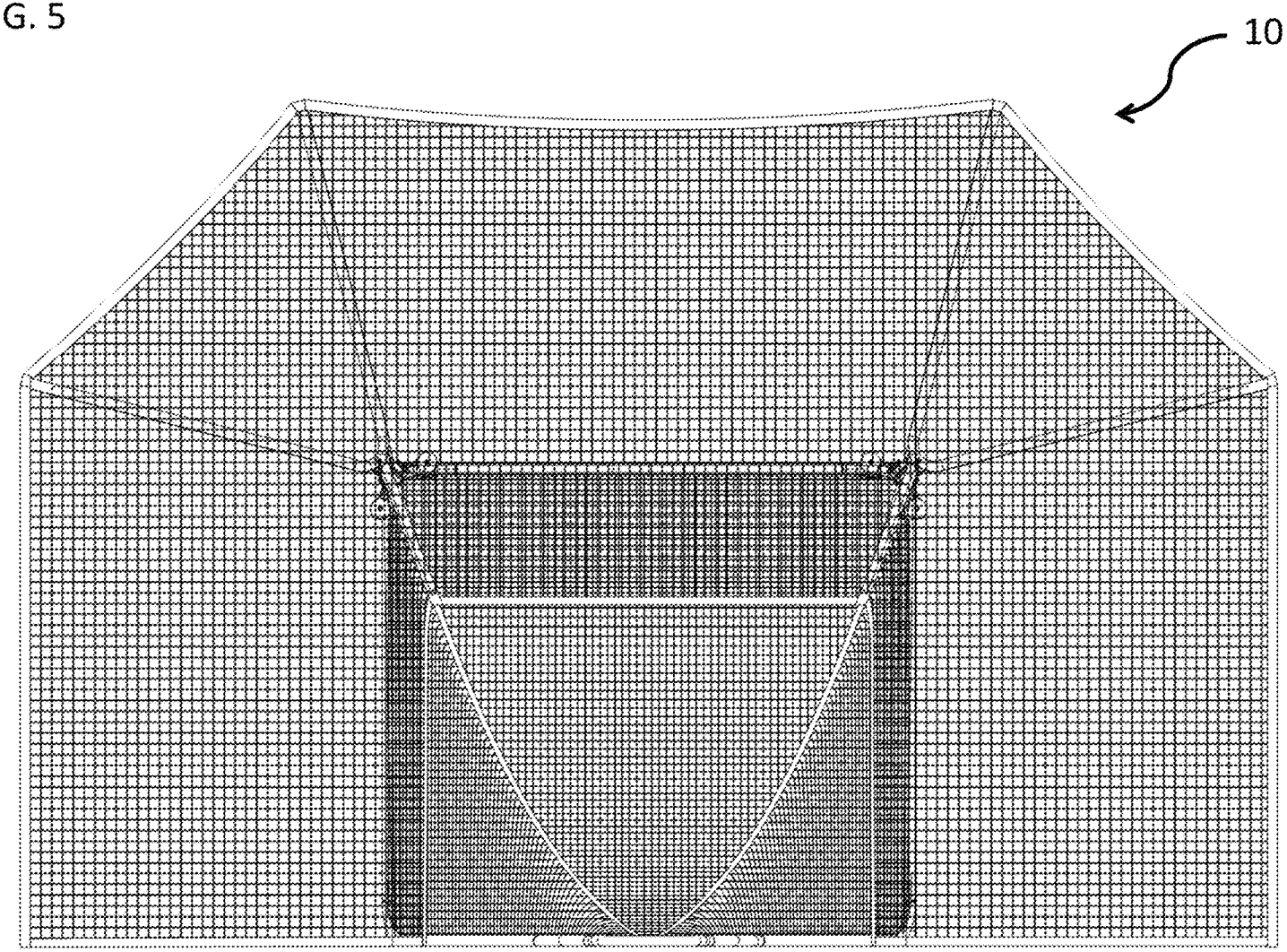
FIG. 5 illustrates a back view of the dual bracket mechanism mounted sports goal practice backstop of the instant invention, attached to an existing goal and fully assembled and raised.
Figure 6:
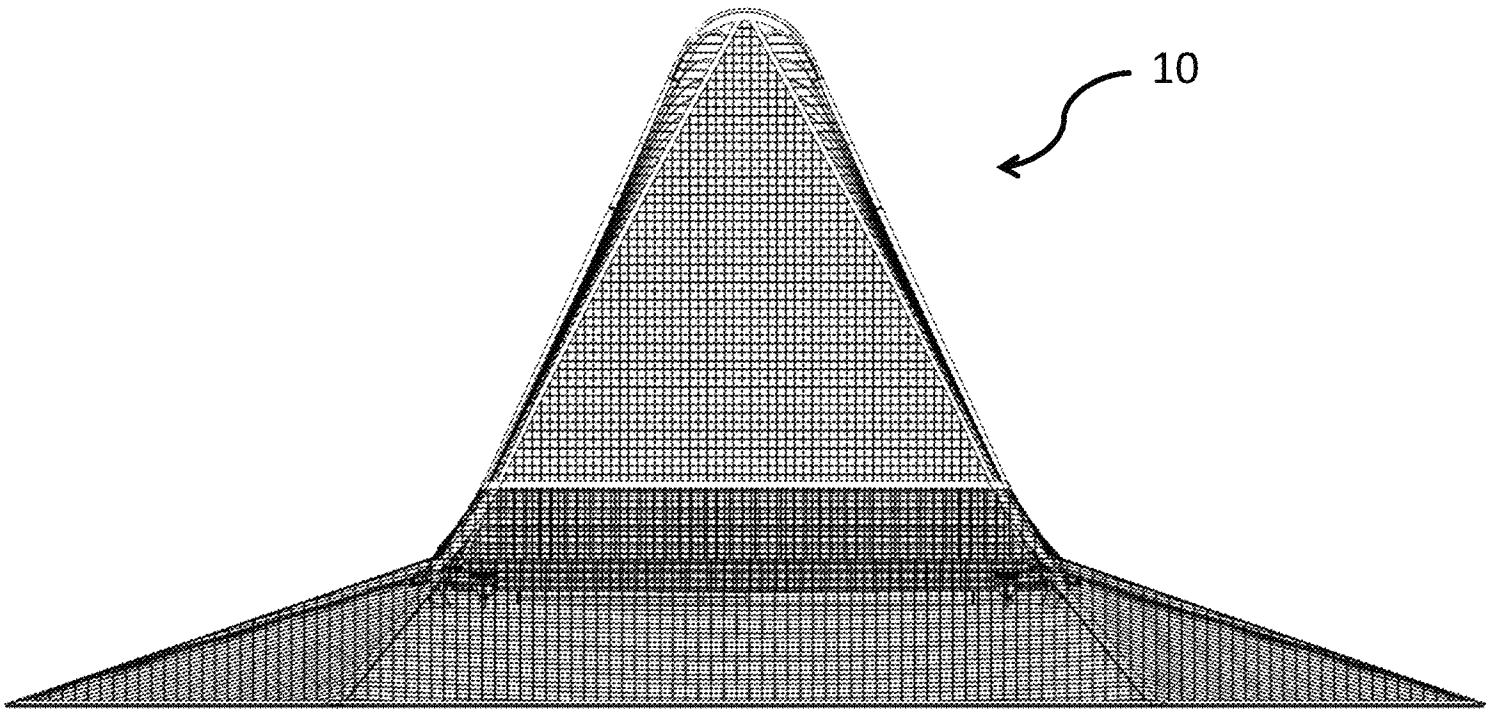
FIG. 6 illustrates a top view of the dual bracket mechanism mounted sports goal practice backstop of the instant invention, attached to an existing goal and fully assembled and raised.
Figure 7:
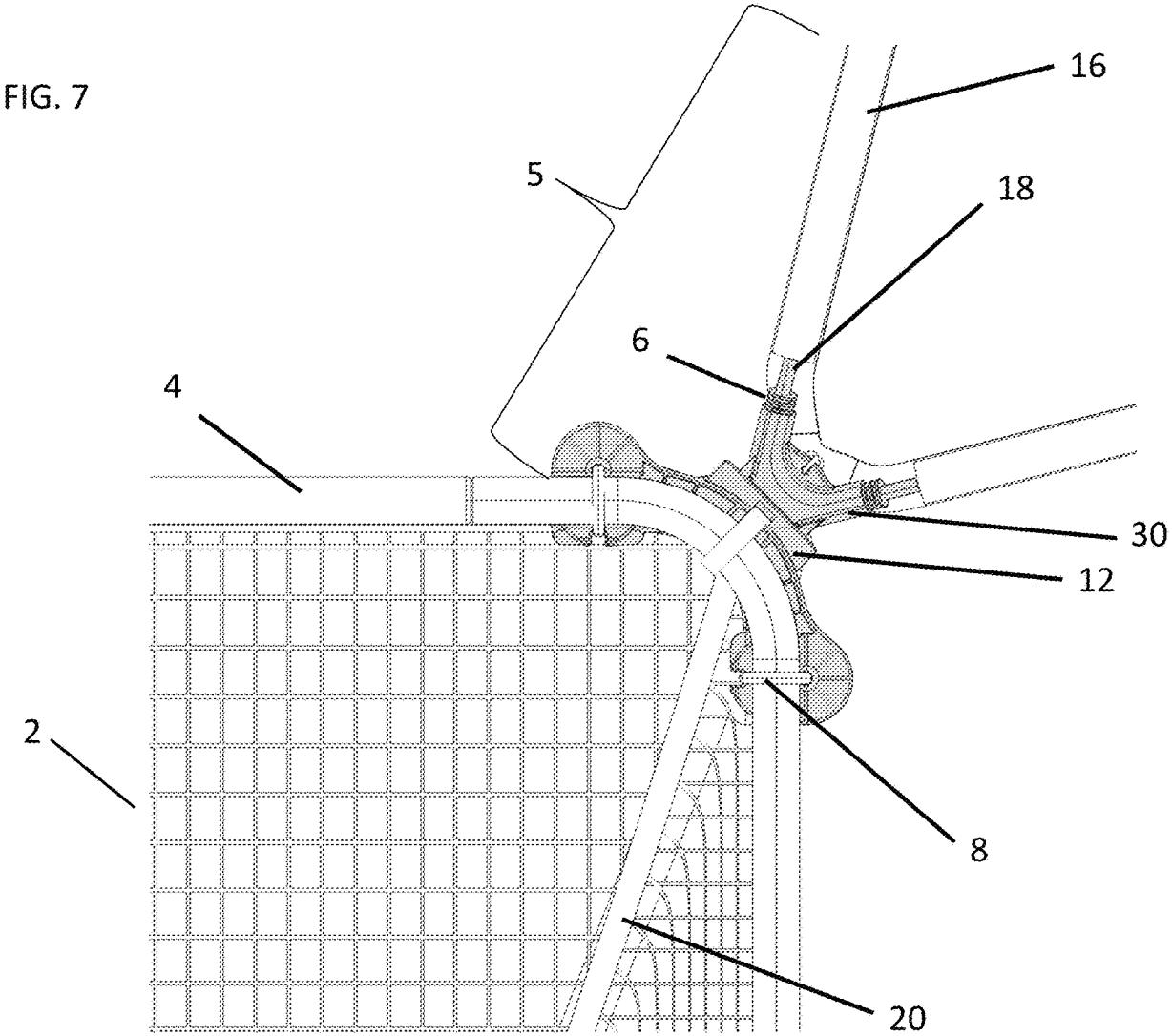
FIG. 7 illustrates an enlarged corner front section view of the right bracket mechanism attached to the right side of an existing goal via the clamp assembly.

Turning to FIG. 7, which illustrates an enlarged corner front section view of one embodiment of the right bracket mechanism attached to the right side of an existing goal. Here, the backstop netting is not shown attached. The bracket mechanism 5 is attached to the right corner of an existing goal. The overall bracket mechanism comprises a corner bracket assembly 12 with a "J" clamp bolt 8. In a preferred embodiment, the "J" clamp bolt is threaded and made from metal or heavy-duty plastic. Also attached to the bracket assembly 12 is a pivot hinge member 30 with impact resistant backstop net supports and poles 18 that are covered by a net pole sleeve 16. In a preferred embodiment, the net support pole 18 has a rubber insert 6 that ensure the backstop net support pole will be impact resistance and allows for the tool less install and removal of the net support poles.

The bracket assembly 5 attaches to the goal frame 4 of a goal 2. The goal typically has a goal net corner binding 20, wherein the bracket mechanism partially attaches to that area. In one embodiment, the bracket assembly 5 is configured as an individual, stand-alone apparatus, without left or right designation, that can be attached to either side of a net frame. Thus, the bracket assembly 5 may be used interchangeably.

In one embodiment, the invention may comprise a sports goal practice backstop for removable attachment to a sports goal 2 and further comprising a right bracket mechanism 5 and a left bracket mechanism, wherein the right and left bracket mechanisms 5 are removably attached by a right and a left attachment mechanism 12 to secure the respective bracket mechanisms in place, with no need for tools.

Figure 8:
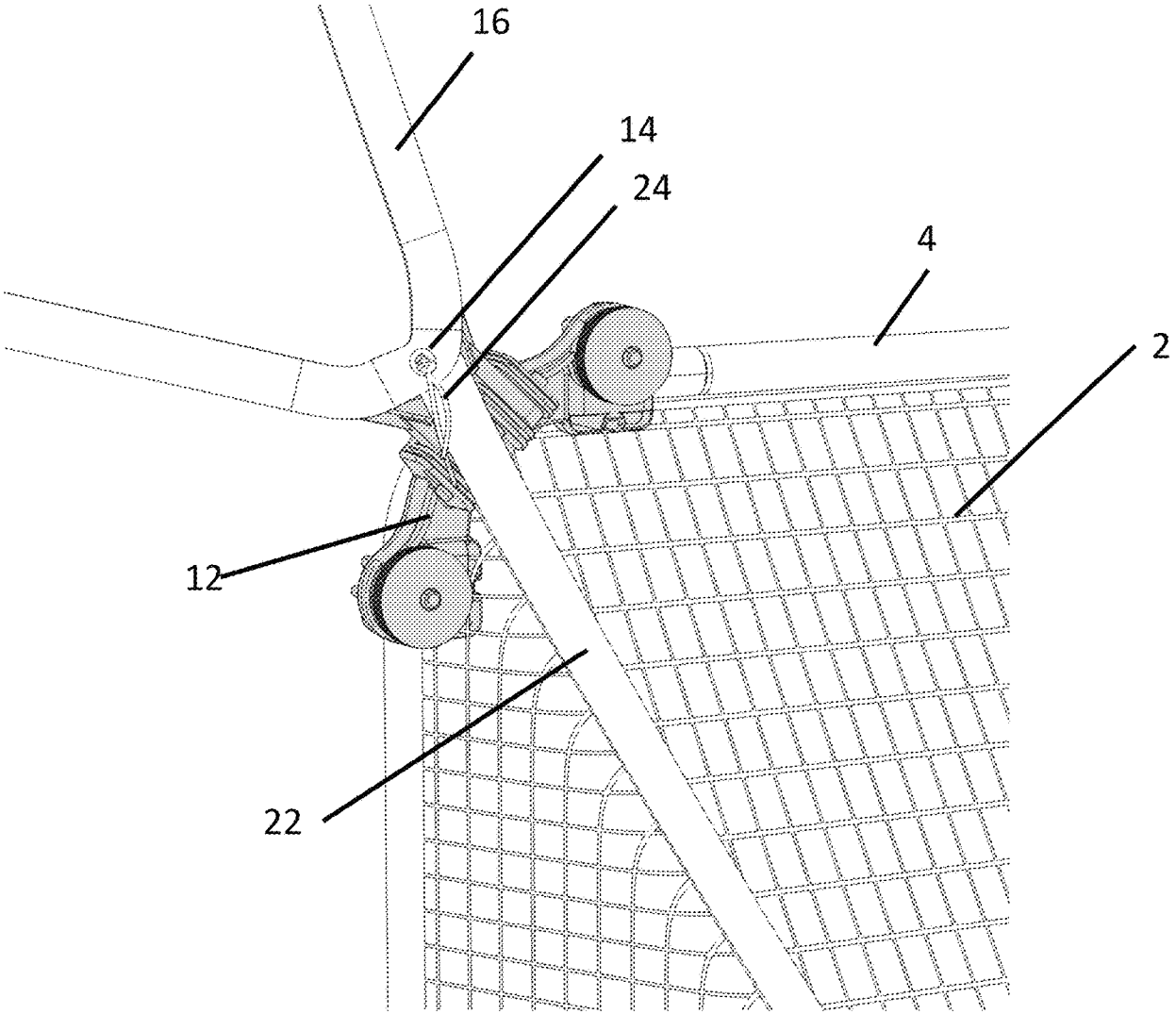
FIG. 8 illustrates an enlarged corner back section view of the right bracket mechanism attached to the right side of an existing goal via the bracket assembly.

FIG. 8 illustrates an enlarged corner back section view of the right bracket mechanism attached to the right side of an existing goal. Here again, the backstop netting is not shown. From this angle, an elastic "tie" cord 24 runs through the net pole sleeve 16 and through an "eyelet" 14. The elastic "tie" cord holds the backstop net system to the corner bracket assembly 12. From this angle, the backstop net control strap 22, which keeps the backstop netting close to the goal 2 when the backstop is being folded to the stowed position behind the goal.

Figure 9:
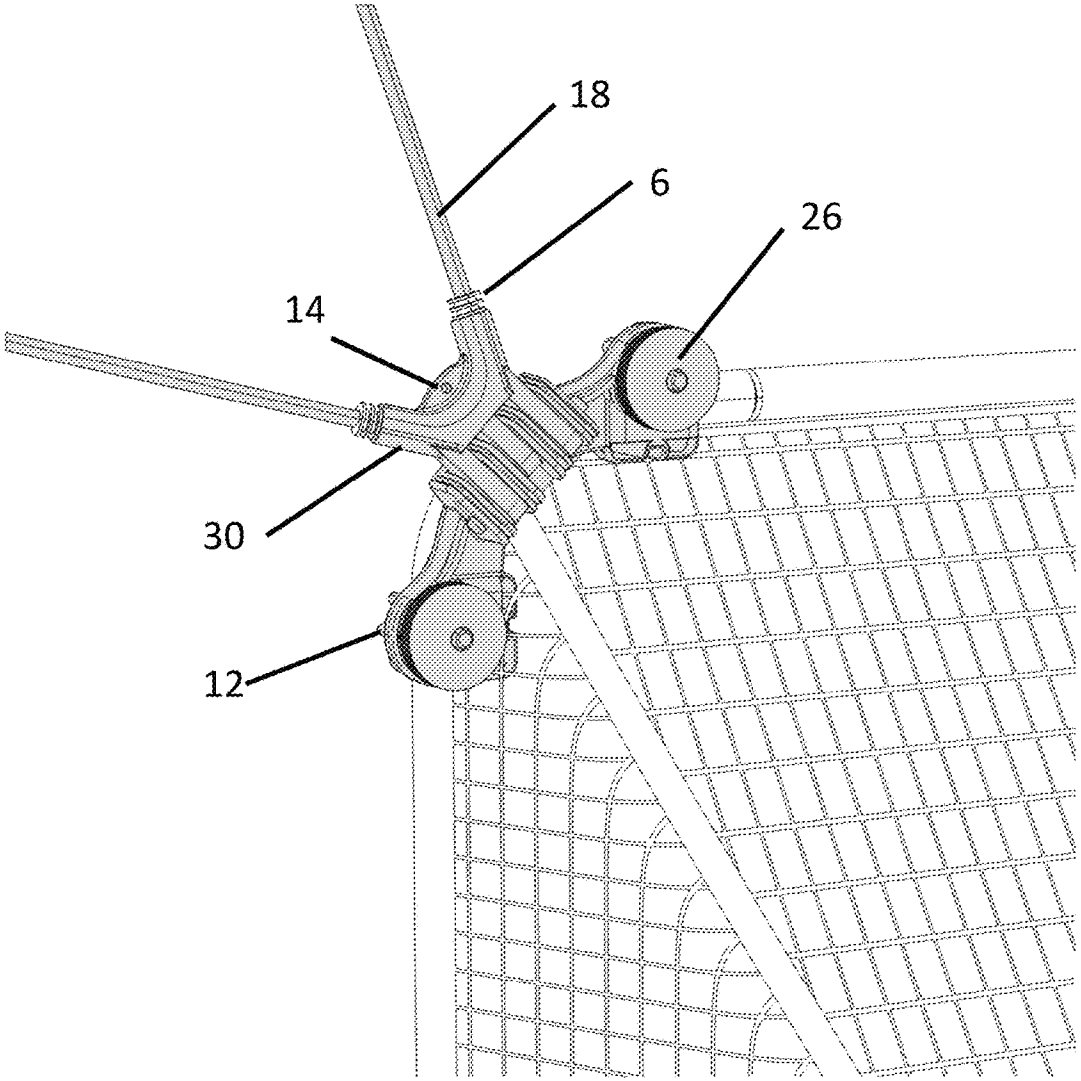
FIG. 9 illustrates an enlarged corner back section view of the right bracket mechanism attached to the right side of the goal.

FIG. 9 illustrates another enlarged back section view of the right bracket mechanism attached to the right side of the goal, wherein the pivot hinge member 30 is in the open position. The corner bracket assembly 12 further comprises a clamp knob apparatus 26. The clamp knob apparatus 26 may have a large diameter in order to prevent catching or snagging in the backstop netting. In this Figure, the net support pole 18 is shown without the net pole sleeve. A rubber insert 6, which is attached to the net support pole 18, assists the net pole to be impact resistant and allows for the tool less installation and removal of the net support poles.

Figure 10:
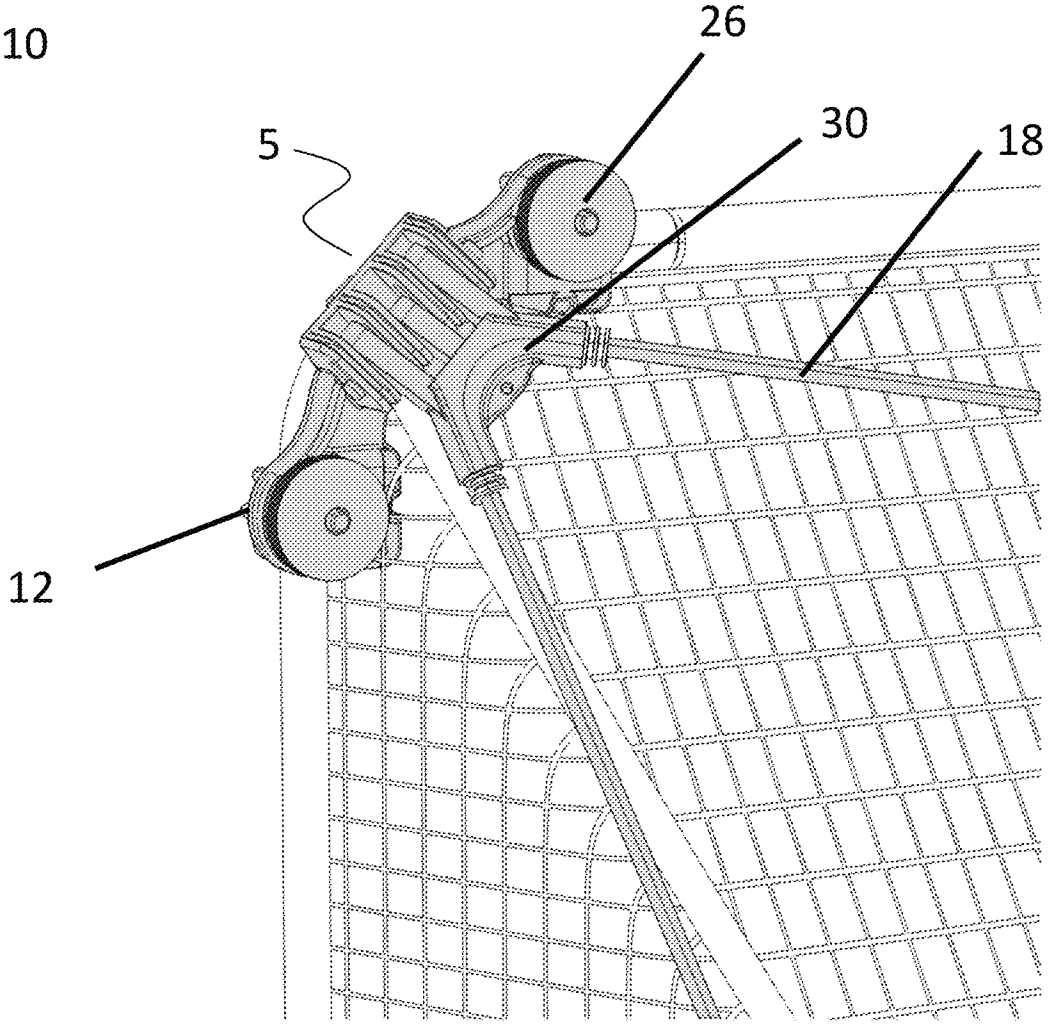
FIG. 10 illustrates an enlarged corner back section view of the right bracket mechanism in the stowed position.

FIG. 10 illustrates another enlarged back section view of the right bracket mechanism attached to the right side of the goal, wherein the pivot hinge member 30 is in the stowed position. Again, the backstop netting is not shown.

Figure 11:
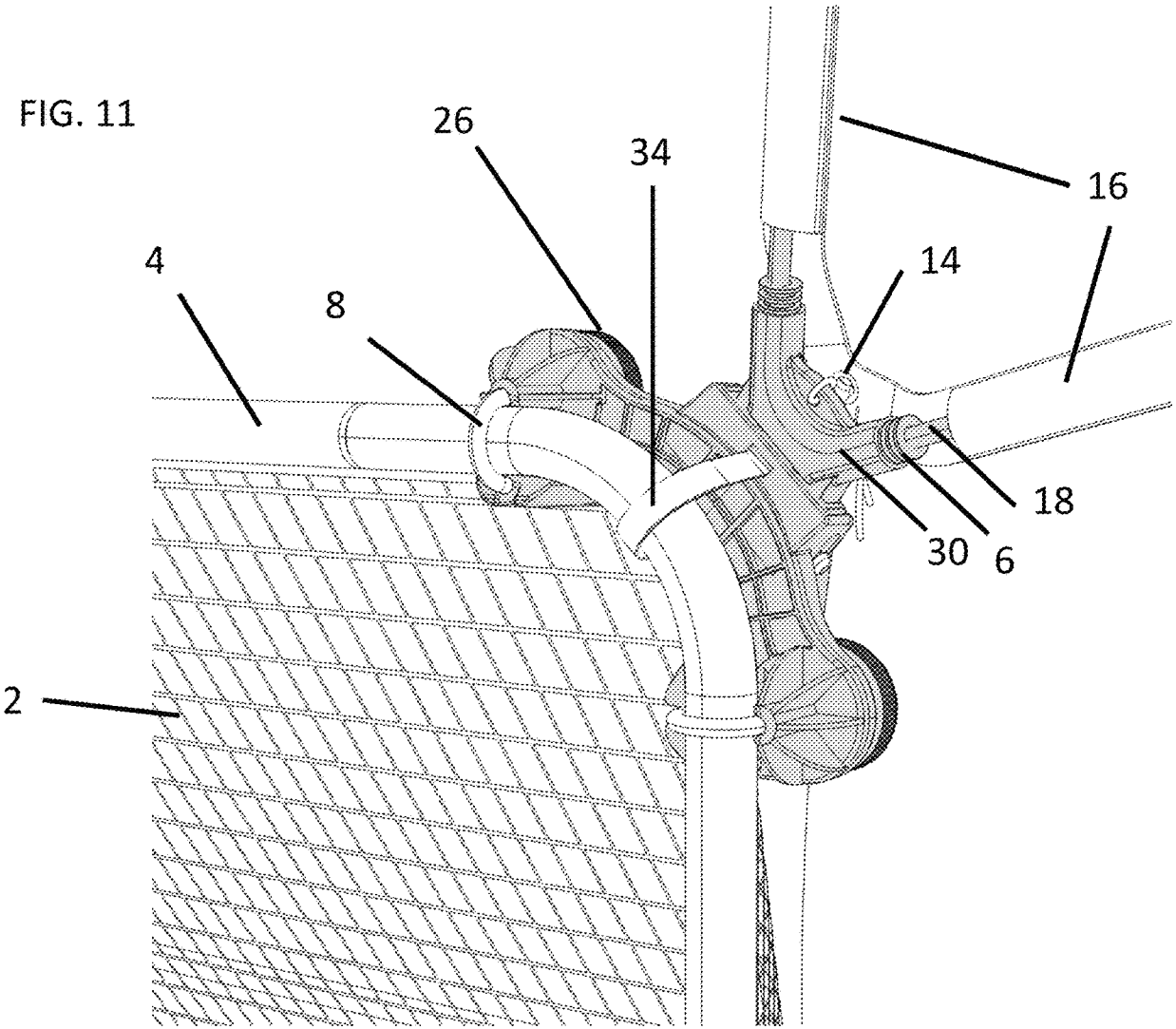
FIG. 11 illustrates an enlarged corner front perspective view of the right bracket mechanism attached to the right side of an existing goal via the bracket assembly.

FIG. 11 is a front perspective view of the enlarged corner of the right bracket mechanism attached to the right side of an existing goal via the bracket assembly. In this embodiment, the "J" bolt 8 is threaded to screw into the clamp knob 26. Also, the net pole sleeves 16 attaches to the pivot hinge member 30 using the elastic "tie" cord 14. The net pole 18 has a rubber insert 6 wherein the insert is incorporated into the pivot hinge member 30 and thus allows for the tool less installation and removal of the net support poles. The Velcro® anti-rotation strap 34 attaches to the goal frame 4 and prevents the bracket mechanism from rotating back into the goal net 2 during use. Here, the bracket mechanism is in the open position, with the backstop netting not shown.

Figure 12:
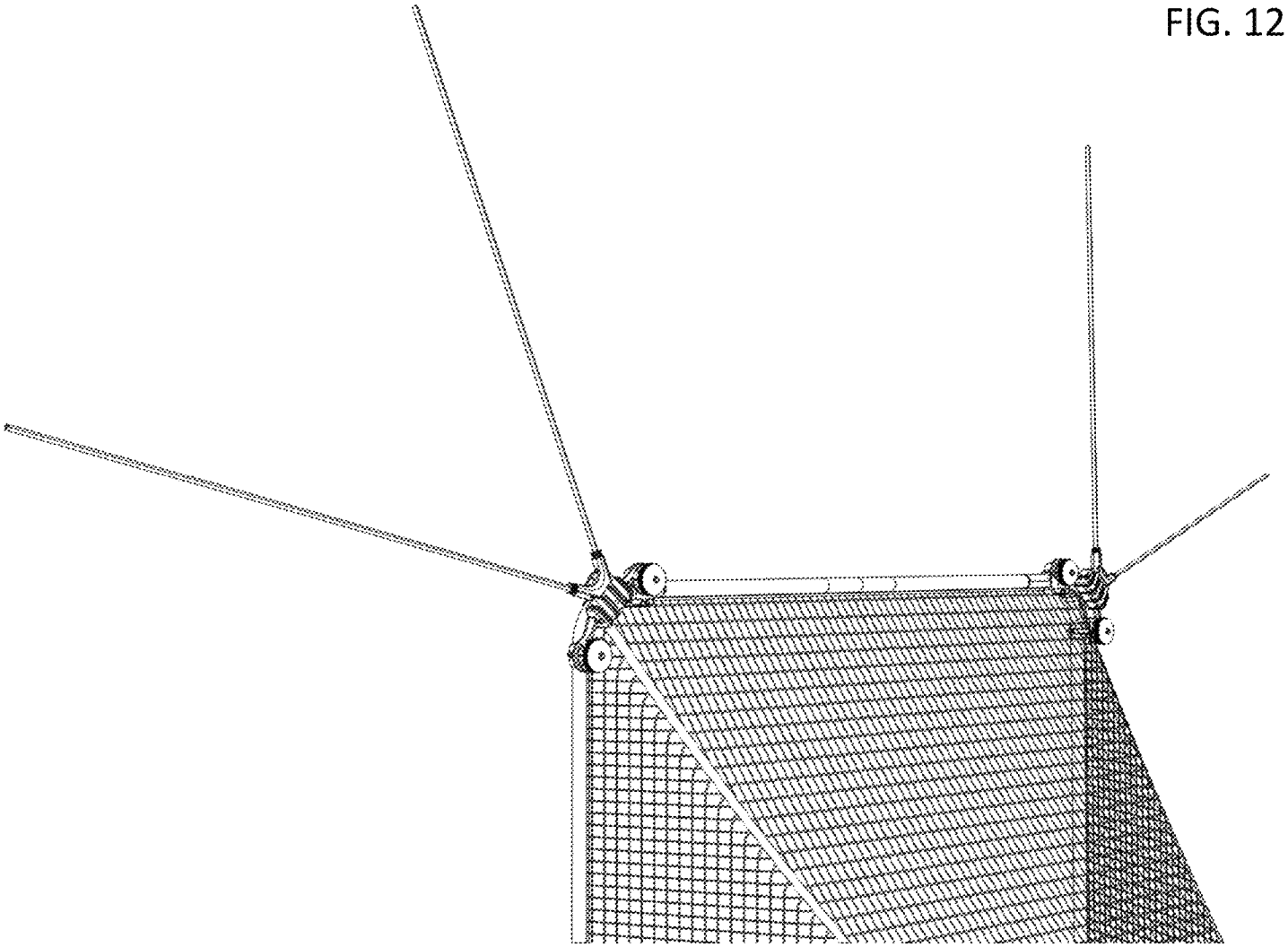
FIG. 12 illustrates a rear perspective view of the dual bracket mechanism mounted sports goal practice backstop of the instant invention fully assembled, but missing the backstop netting.

FIG. 12 illustrates a rear perspective view of the dual bracket mechanism mounted sports goal practice backstop of the instant invention fully assembled, but missing the backstop netting. Here, the dual bracket mechanisms are in the full opened position.

Figure 13:
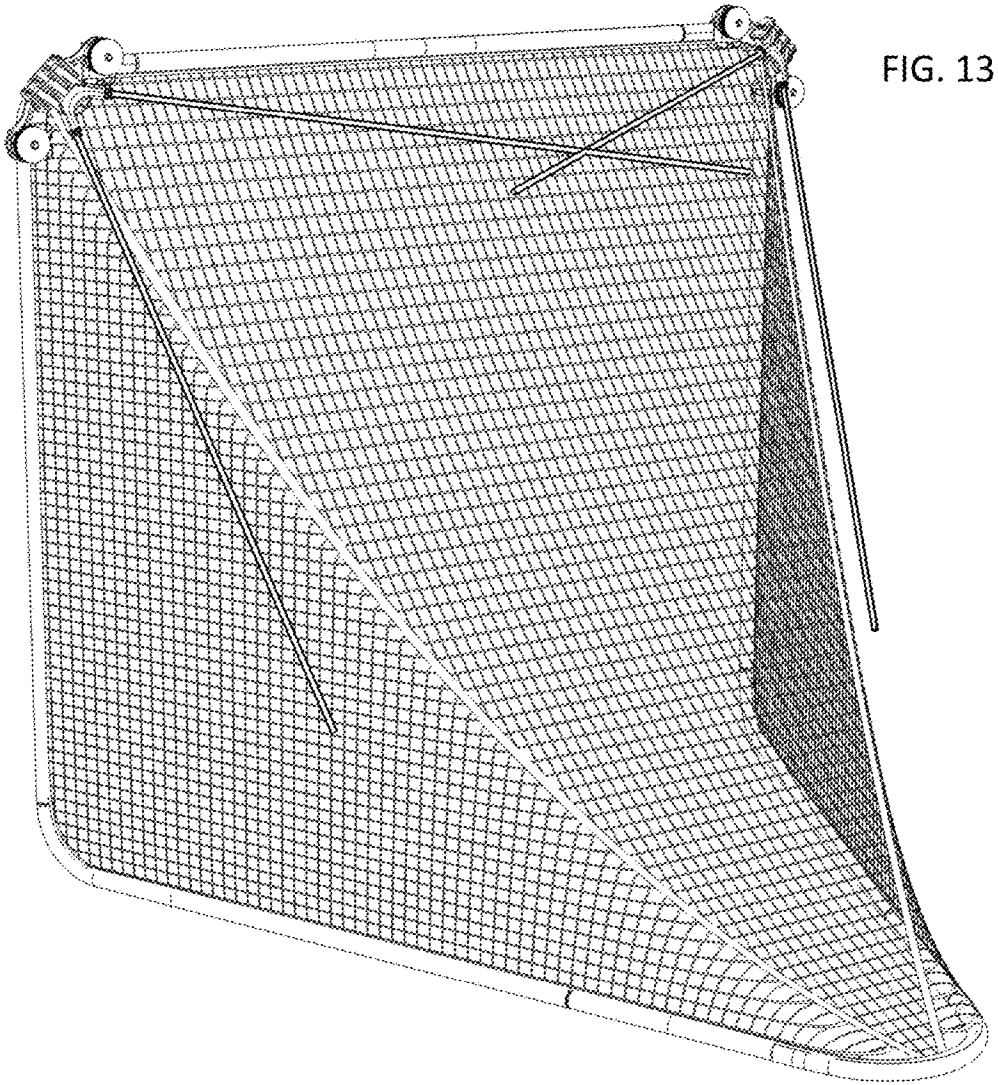
FIG. 13 illustrates a rear perspective view of the dual bracket mechanism mounted sports goal practice backstop of the instant invention in the stowed position, missing the backstop netting.

FIG. 13 illustrates the rear perspective view of the dual bracket mechanism mounted sports goal practice backstop of the instant invention in the stowed position. This position is used when the practice backstop is not in use and tucks behind the sports goal. Again, the backstop netting is not shown.

Figure 14:
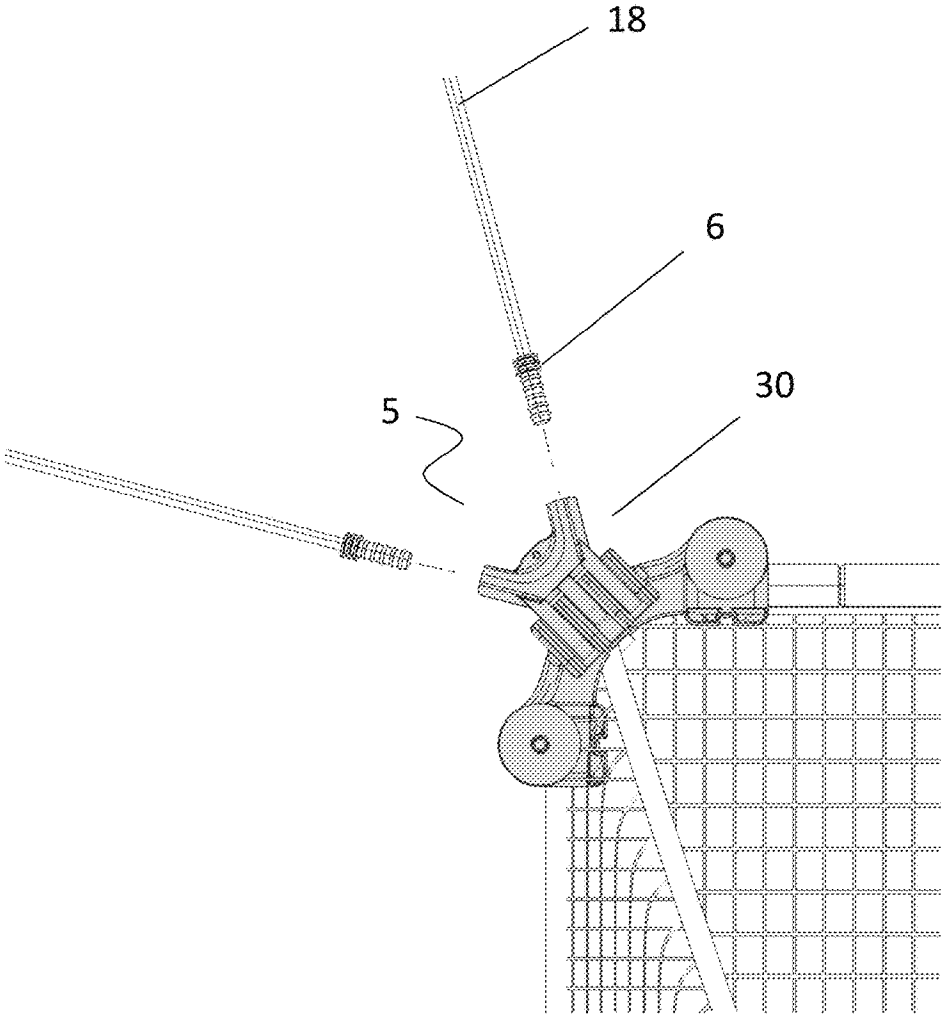
FIG. 14 illustrates an enlarged corner back section view of the right bracket mechanism attached to the right side of the goal to show the net pole assembly.

FIG. 14 illustrates an enlarged corner back section view of the right bracket mechanism 5 attached to the right side of the goal to show how the net poles 18 with rubber inserts 6 are introduced and inserted into the pivot hinge member 30 and thus allows for the tool less installation and removal of the net support poles 18.

Figure 15:
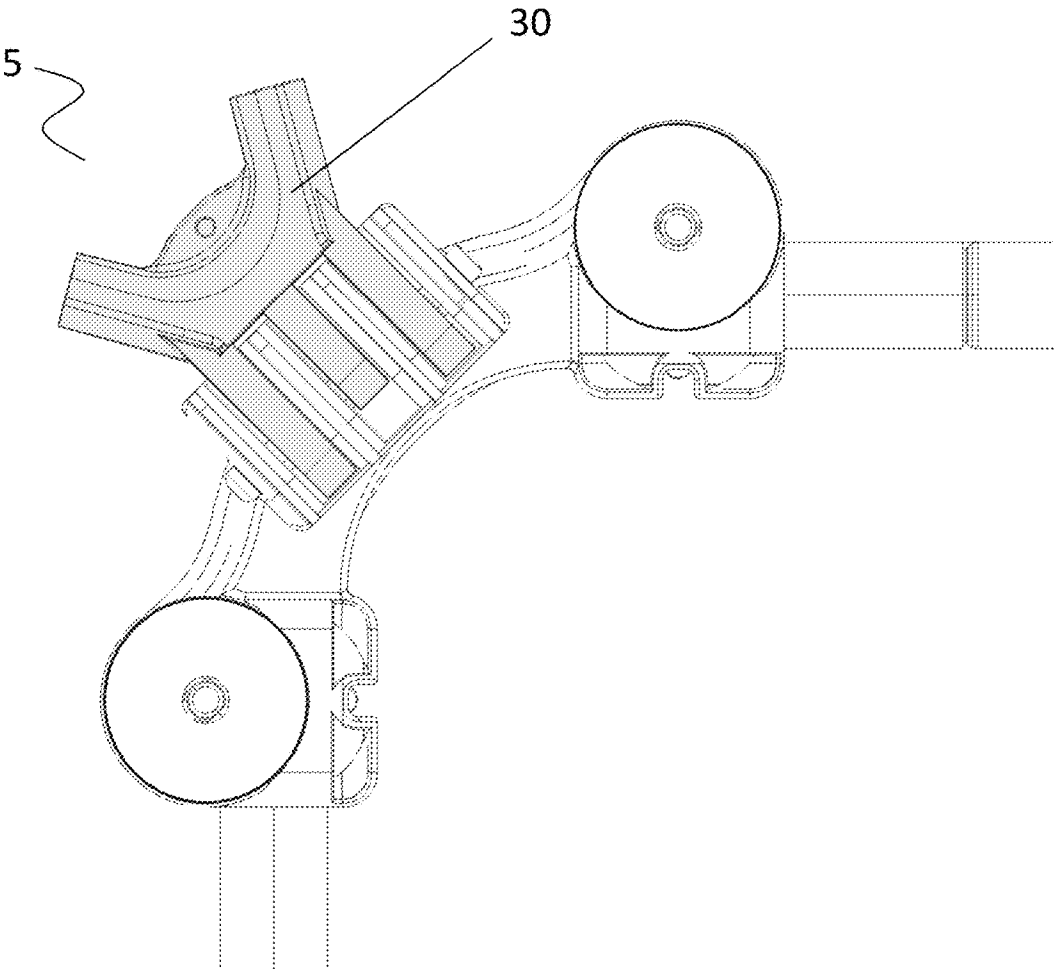
FIG. 15 illustrates an enlarged back sectional view of the latched pivot hinge member attached to the right bracket mechanism without the poles shown.

FIGS. 15 to 20 illustrate embodiments of different views of an enlarged front section of the pivot hinge member 30. FIG. 15 shows one embodiment of the pivot hinge member in the latched position. In this position, the pivot hinge member is locked in a down position and when the net poles are assembled and attached to the pivot hinge member, the backstop netting is in a fully assembled and raised position.

Figure 16:
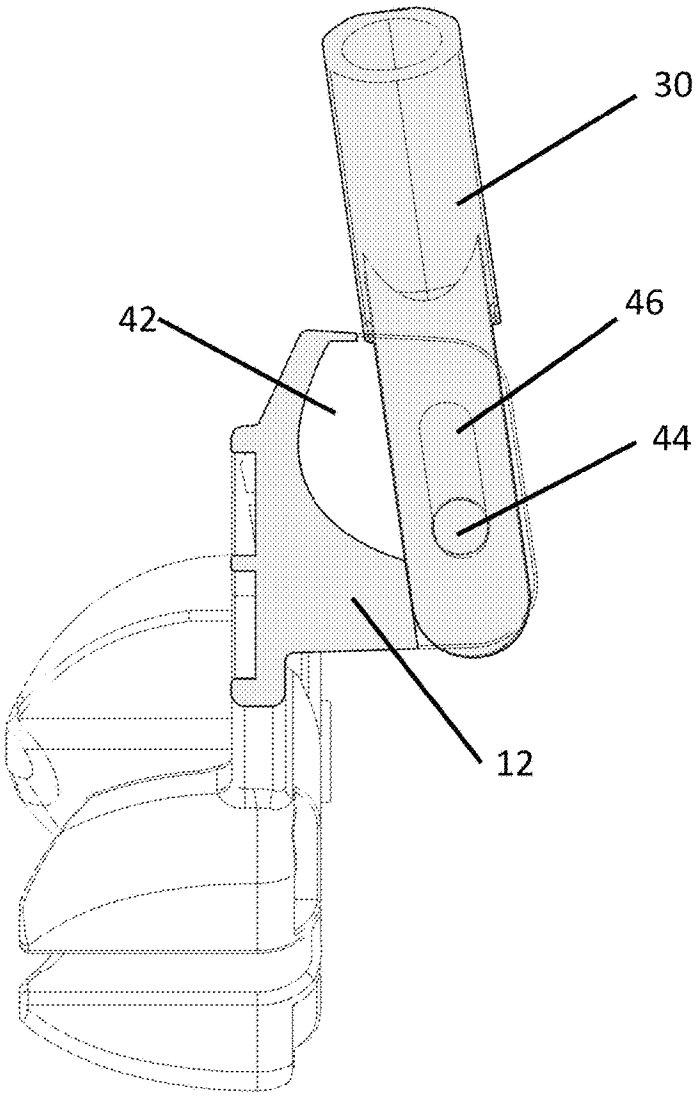
FIG. 16 illustrates an enlarged side sectional view of the latched pivot hinge member.

FIG. 16 illustrates an enlarged side section view of the pivot hinge member 30 in the latched position. The pivot hinge member is in communication and attached to the corner bracket mechanism 12 at a landing area. The corner bracket pocket 42 allows the pivot hinge member 30 to rotate freely into the latched and unlatched position. When the pivot hinge member is in a latched position the pivot hinge 30 is in a down position. In the unlatched position, the pivot hinge 30 is in an up position. A steel axel 44 is attached on the pivot hinge member 30. The steel axel 44 moves up and down through a slot 46 that is attached to the corner bracket. The steel axel is able to move the pivot hinge to the up and down position based on the slot position.

Figure 17:
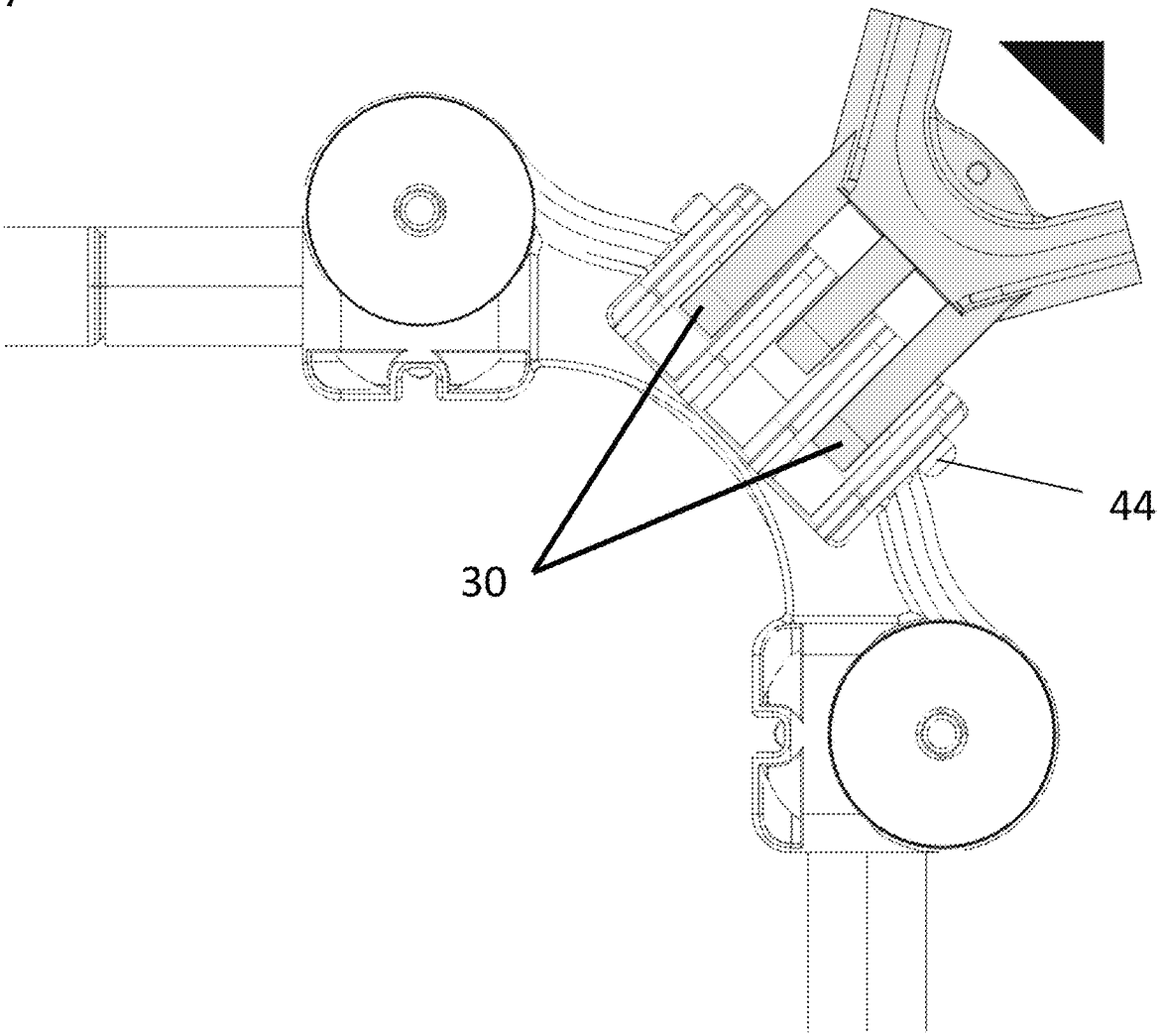
FIG. 17 illustrates an enlarged back sectional view of the unlatched pivot hinge member.

FIG. 17 illustrates an enlarged front section view of the pivot hinge member 30 in the unlatched position. Here, the pivot hinge is moved into an unlatched position where the pivot hinge's steel axel is moved to an up position. A user moves the pivot hinge member 30 from the down, latched position to the up, unlatched position.

Figure 18:
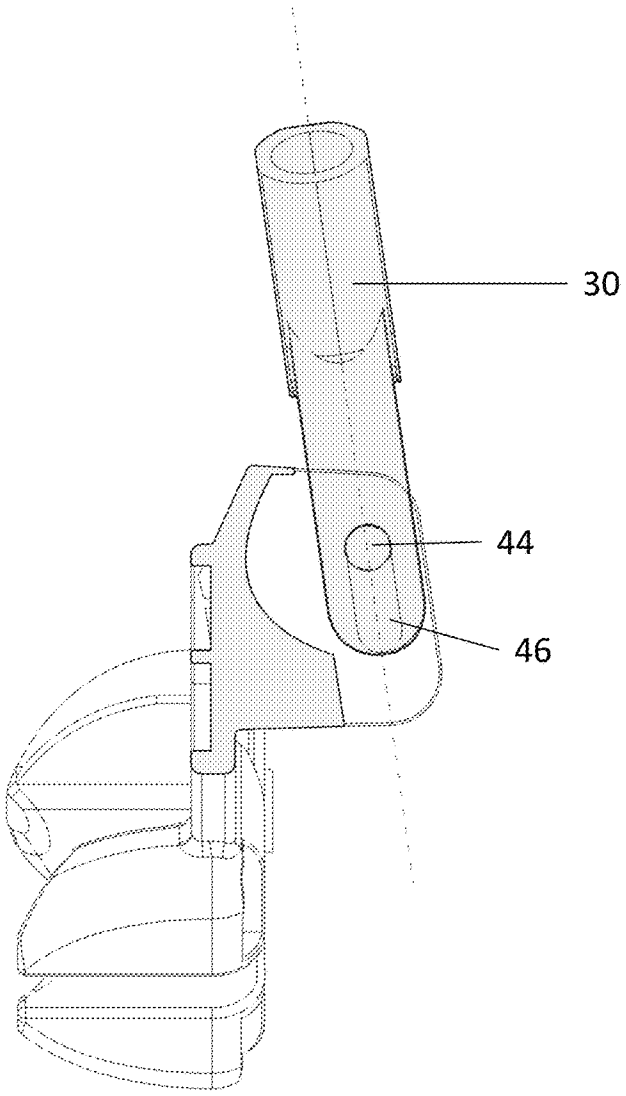
FIG. 18 illustrates an enlarged side sectional view of the unlatched pivot hinge member.

FIG. 18 illustrates and enlarged side section view of the pivot hinge member in the unlatched position. Here, the steel axel 44 is in the up position on the slot of the corner bracket assembly 46. The up position is the unlatched position of the pivot hinge 30. When in the unlatched position, the pivot hinge member 30 is freely rotatable so that the backstop net may be stowed behind a goal net when not in use.

Figure 19:
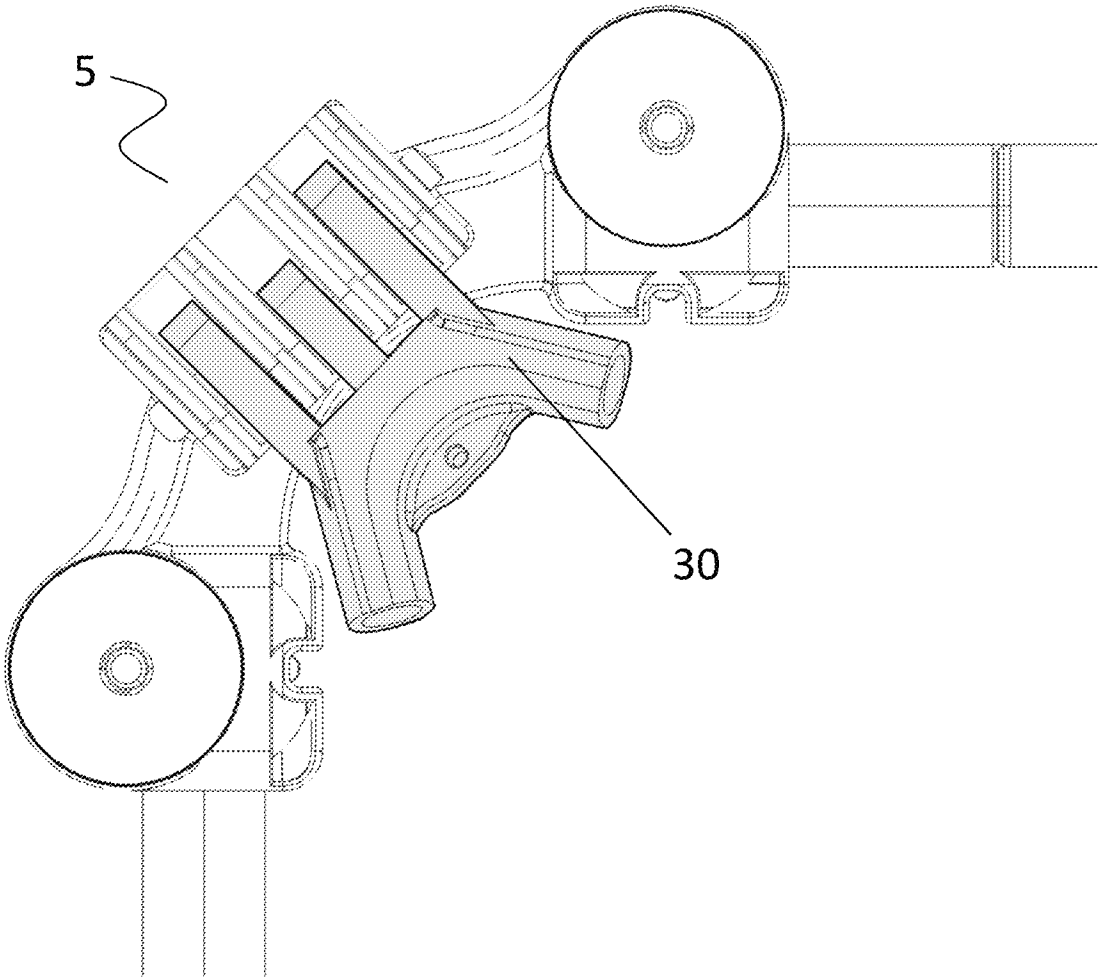
FIG. 19 illustrates an enlarged front section view of the unlatched, folded, pivot hinge member.

FIG. 19 shows the pivot hinge 30 in the folded, stowed position. This position allows the backstop netting to be stowed behind the goal net.

Figure 20:
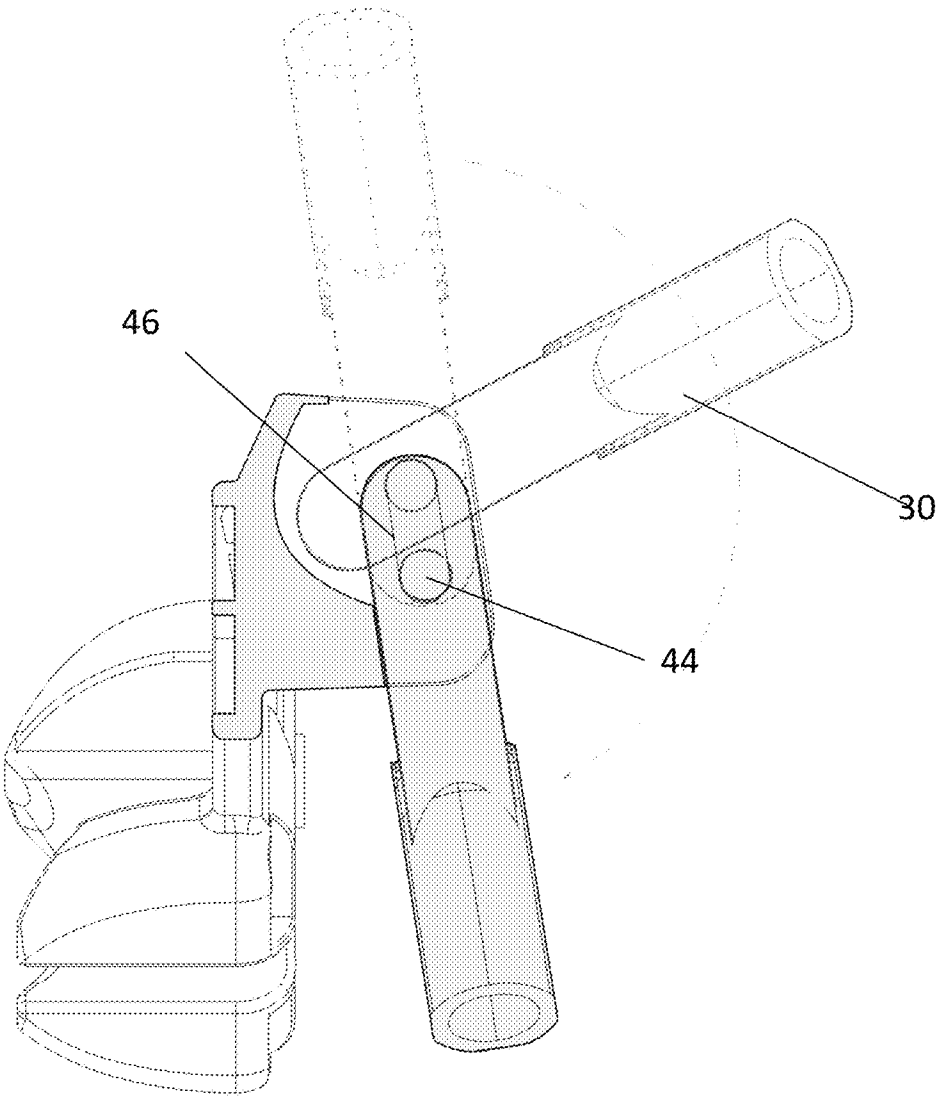
FIG. 20 illustrates enlarged side sectional view of the pivot hinge member and its hinging motions.

FIG. 20 shows the side view of the pivot hinge member 30 and the differing hinging movements. The pivot hinge member 30 is moveable into an up and down position via the steel axel 44 in the slot of the corner bracket assembly 46.

Figure 21:
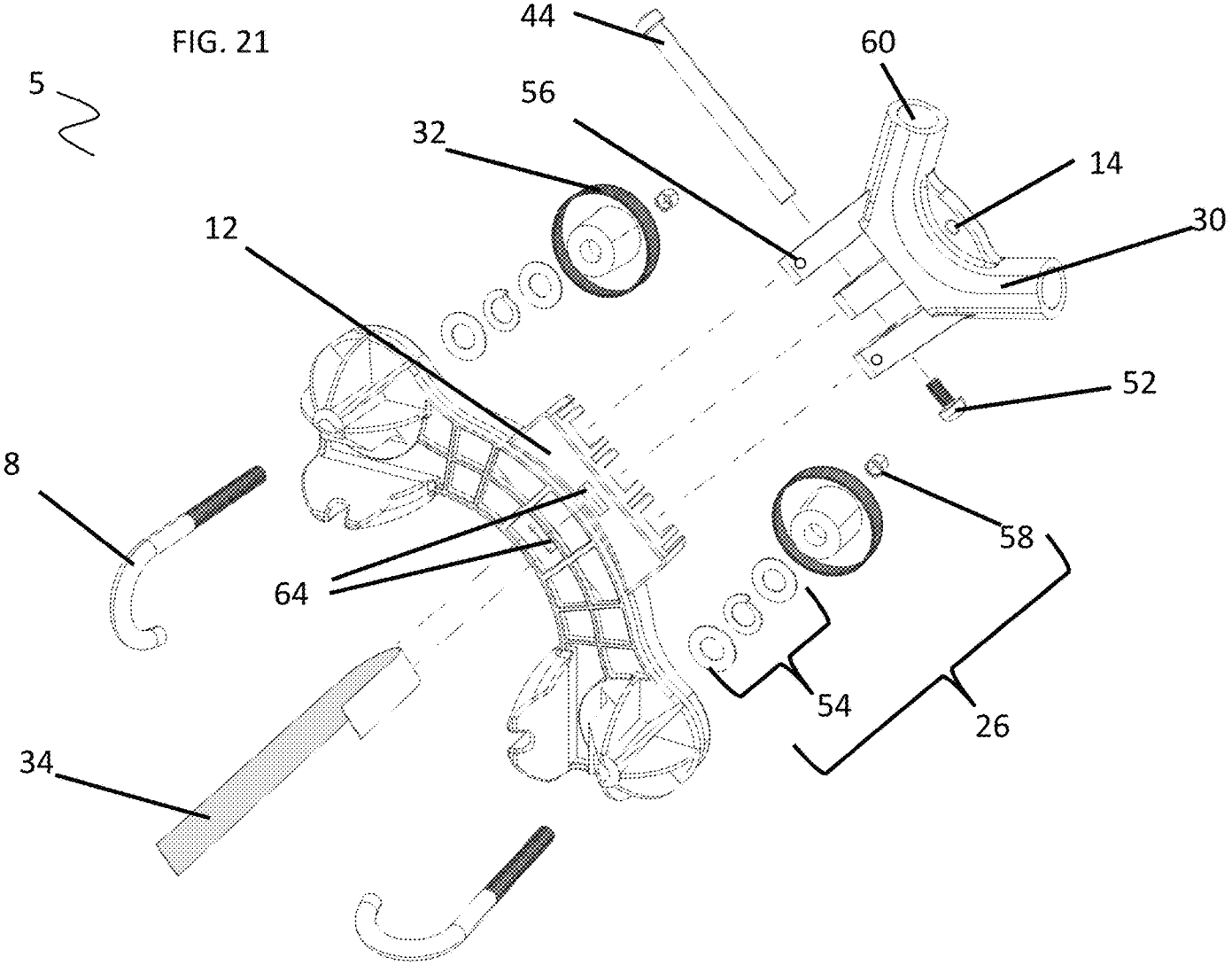
FIG. 21 illustrates an exploded view of the assembly of the corner bracket mechanism.

FIG. 21 illustrates an exploded view of one embodiment of the assembly of the corner bracket mechanism with all the parts that comprise the overall corner bracket mechanism. The pivot hinge member 30 comprises of an eyelet 14, wherein an elastic tie cord attaches to the backstop net system to the pivot hinge member. The pivot hinge member possesses a net pole rubber insert receiving aperture or hole 60 which is able to receive the net pole. The pivot axel 44 runs through the pivot hinge member and is secured with an axel screw 52. The pivot hinge locking mechanisms 56 allows the pivot hinge member to make contact with the corner bracket landing area 12. An impact resistant corner bracket 12 attaches to the clamp knob apparatus 26 with washers 54, a polymer cap 58 and the "J" bolt clamp 8. The bolt clamp 8 attaches the corner bracket mechanism to the goal. The Velcro® anti-rotation strap 34 attaches to the corner bracket mechanism 12 through anti-rotation slots 64 for the hook and loop strap.

Figure 22:
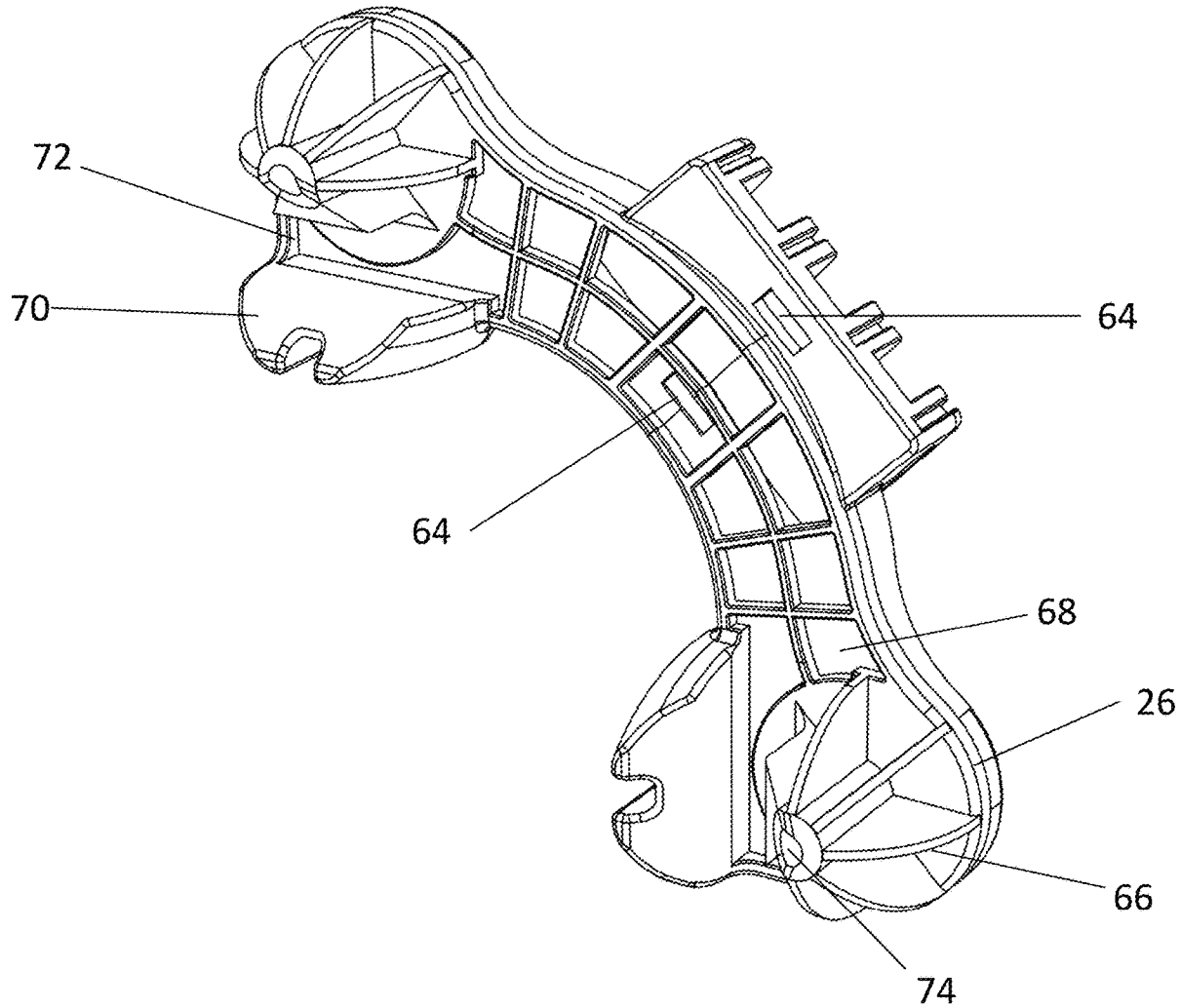
FIG. 22 illustrates an enlarged perspective view of the corner bracket mechanism.

FIG. 22 illustrates an enlarged perspective view of the bracket mechanism 5. In this embodiment, the corner bracket mechanism has pocket areas 68 and rib areas 66 for weight reduction and added strength. The corner bracket mechanism also contains an aperture or hole 74 in the corner bracket 26 for the "J" bolt. The anti-rotation slots 64 accept hook and loop straps like the Velcro® anti-resistant strap. A v-shaped, self-centering geometry 70 allows the bracket mechanism to fit all goal frame pipe diameters. There is also a bracket clearance channel 72 for goal frames with lacing bars.

Figure 23:
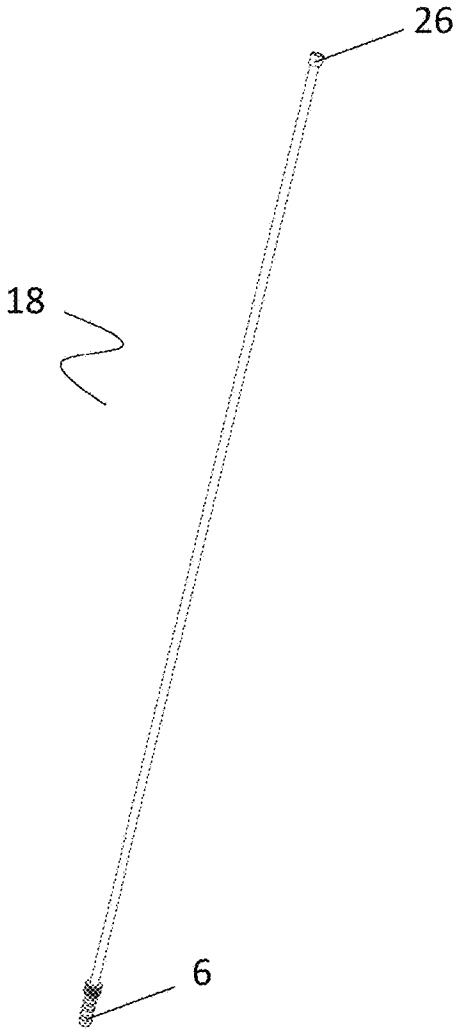
FIG. 23 illustrates a perspective view of an assembled net pole.

FIG. 23 is a perspective view of an assembled net support pole with a rubber insert 6. Here, the net support pole 18 is showed not covered by a net pole sleeve.

Figure 24:
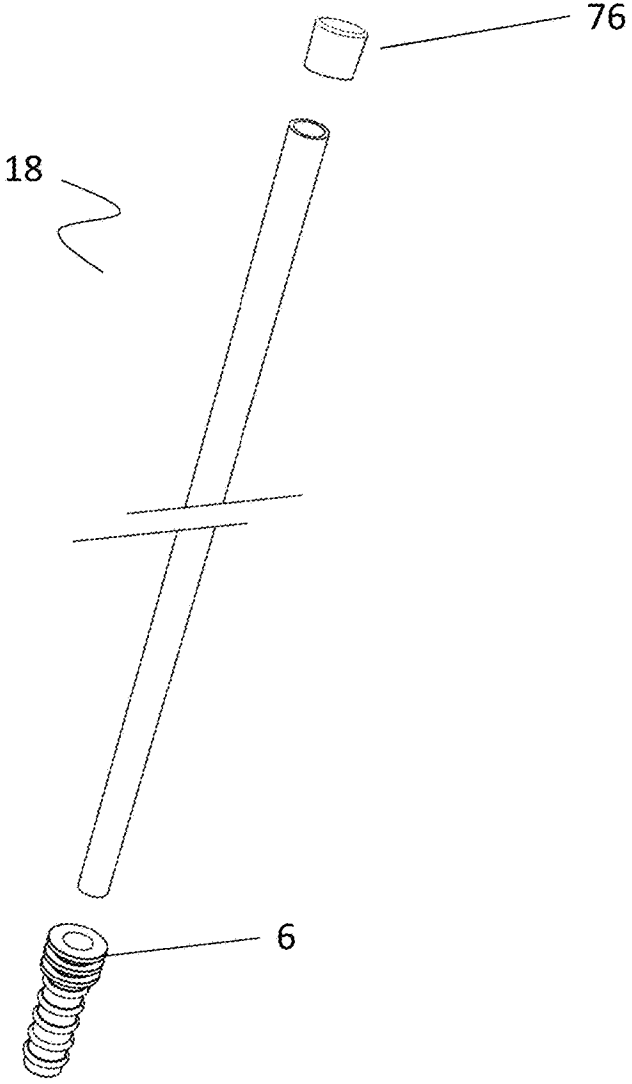
FIG. 24 illustrates an explode component view of the net pole.

FIG. 24 shows an exploded component view of the net support pole 18. Herein the rubber insert 6 (shown in the assembly or exploded view) is in usage attached to the net support pole. The net support pole may be made from polymeric materials in order to be impact resistant. The net support pole is capped with a polymer or rubber end cap 76 to prevent the pole from tearing through the net support pole sleeve (not shown).

Figure 25:
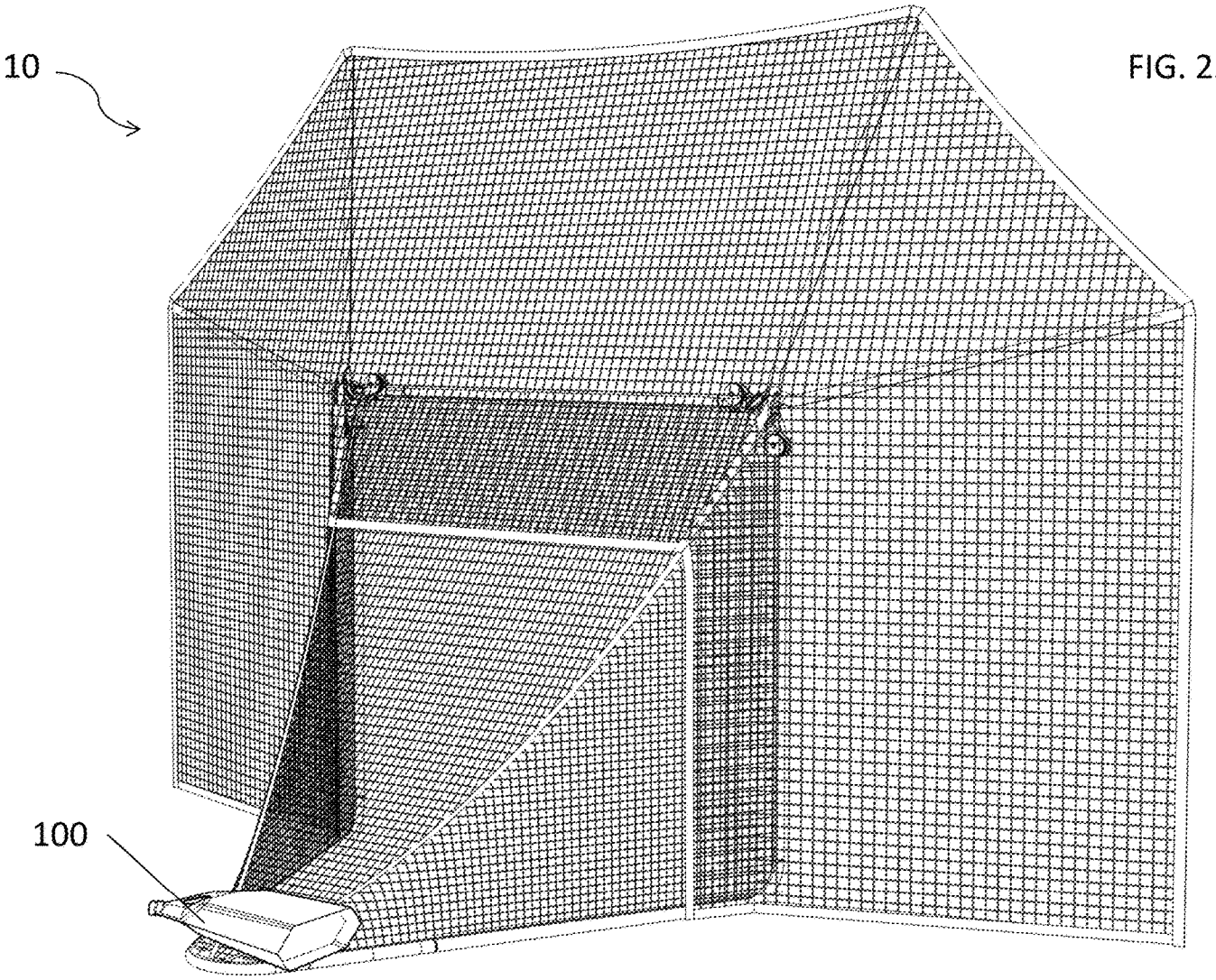
FIG. 25 illustrates a rear perspective view of the dual bracket mechanism mounted sports goal practice backstop of the instant invention, with netting and perspective view of the counterweight mechanism.

FIG. 25 illustrates a rear perspective view of the dual bracket mechanism mounted sports goal practice backstop 10 of the instant system, with netting and perspective view of the counterweight mechanism 100 in use. The counterweight mechanism allows for counterbalancing so that when the backstop netting is fully assembled and raised, it does not topple the goal.

Figure 26:
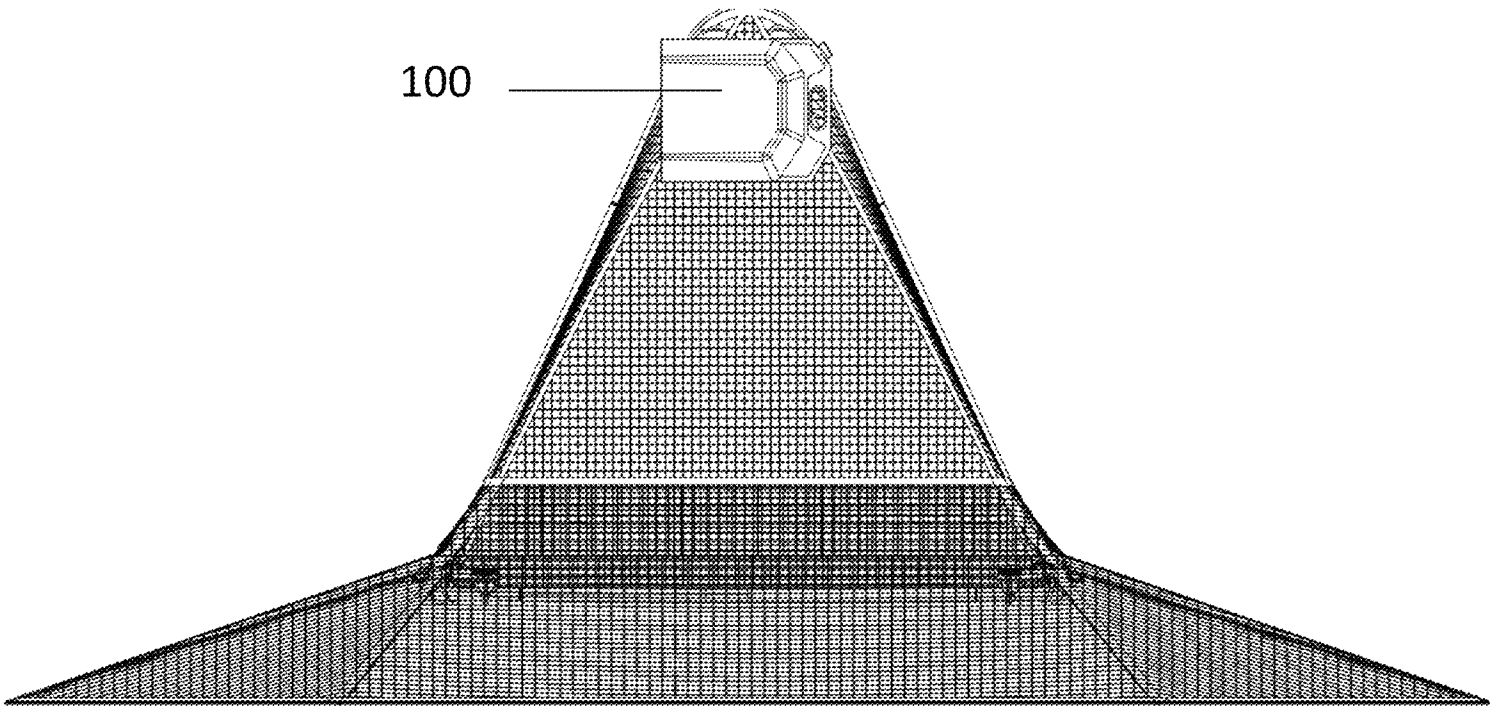
FIG. 26 illustrates a top view of the dual bracket mechanism mounted sports goal practice backstop of the instant invention with a top view of the counterweight mechanism.

FIG. 26 illustrates a top view of the dual bracket mechanism mounted sports goal practice backstop of the instant invention with a top view of the counterweight mechanism 100.

Figure 27:
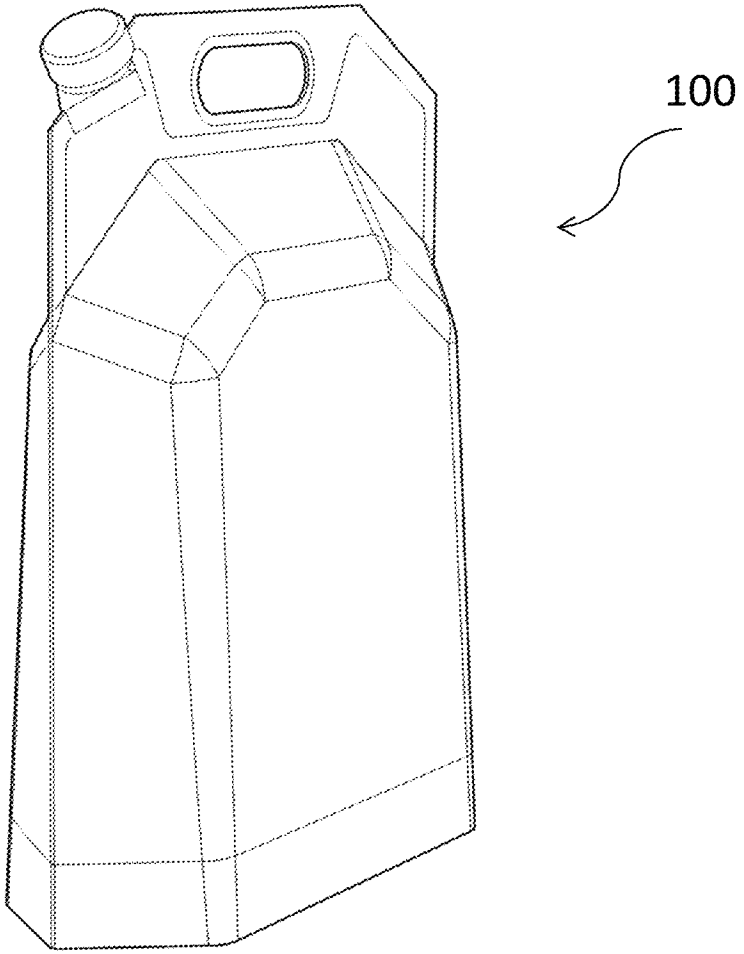
FIG. 27 illustrates a perspective view of the counterweight mechanism.

FIG. 27 illustrates a perspective view of one embodiment of the counterweight mechanism 100. In various embodiments, the counterweight mechanism 100 may be made with metal, heavy-duty plastic, or other suitable materials. The counterweight mechanism may be filled with sand, water, or be one solid component.

Figure 28:
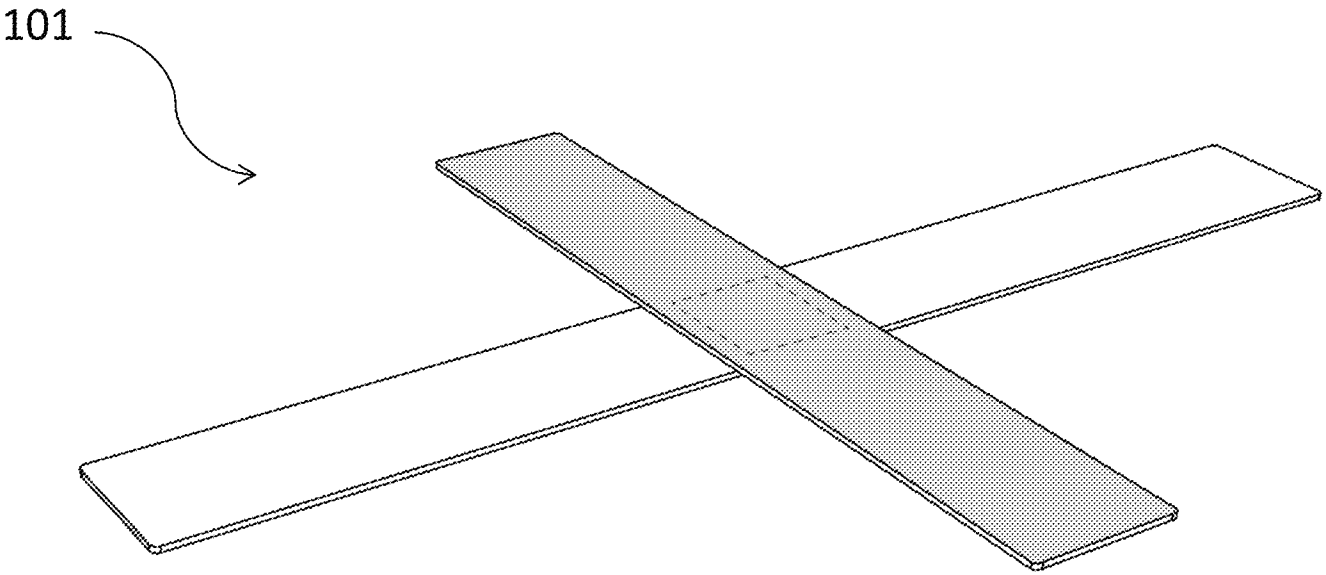
FIG. 28 illustrates a flat view of the cross strap apparatus of the dual bracket mechanism mounted sports goal practice backstop of the instant invention.

FIG. 28 illustrates a flat view of the cross strap apparatus 101 of the dual bracket mechanism mounted sports goal practice backstop of the instant system. This strap is used to attach the backstop netting to the goal frame.

Figure 29:
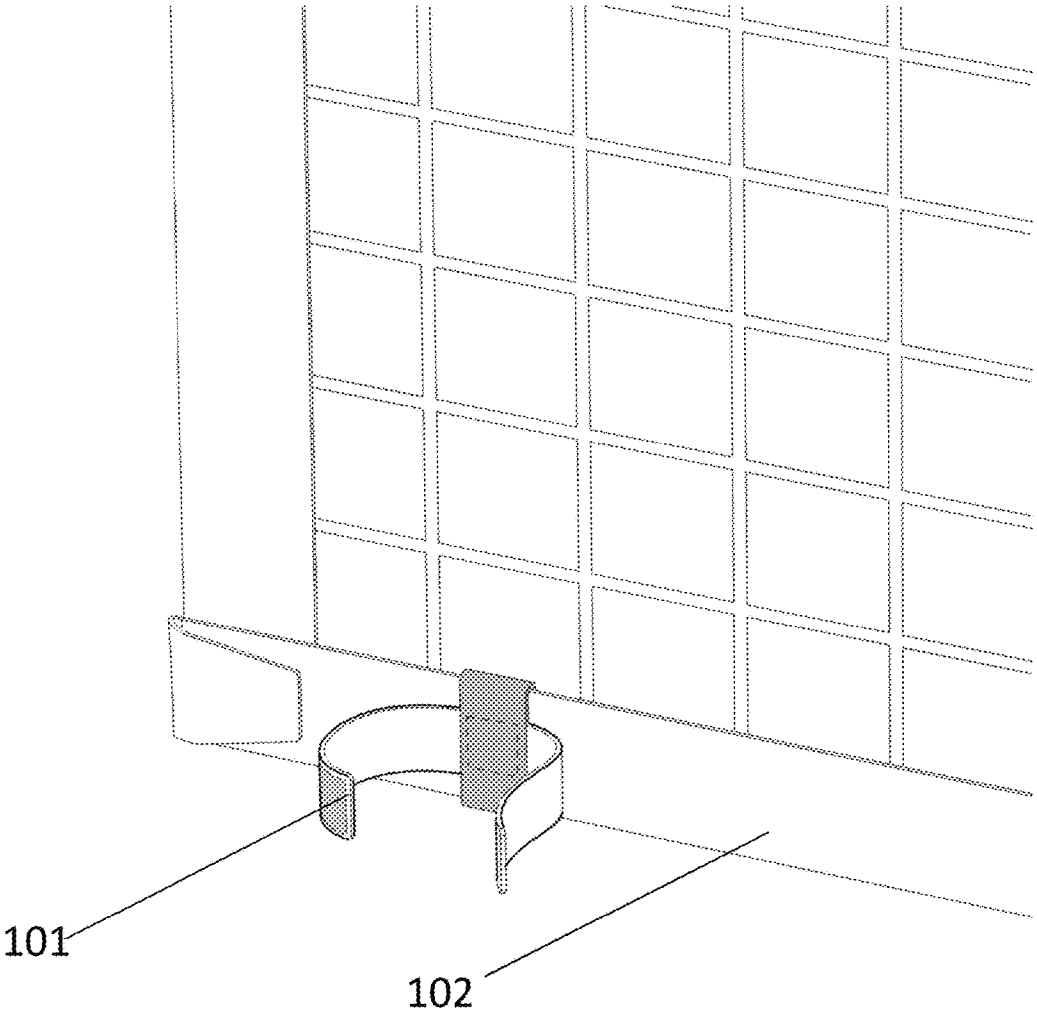
FIG. 29 illustrates an enlarged perspective view of the net wing cross strap apparatus attached to the backstop netting.

In one embodiment, shown in FIG. 29, the net wing cross strap apparatus 101 is attached to a goal net wing base 102. The cross strap attaches the net wing base to the goal frame.

Figure 30:
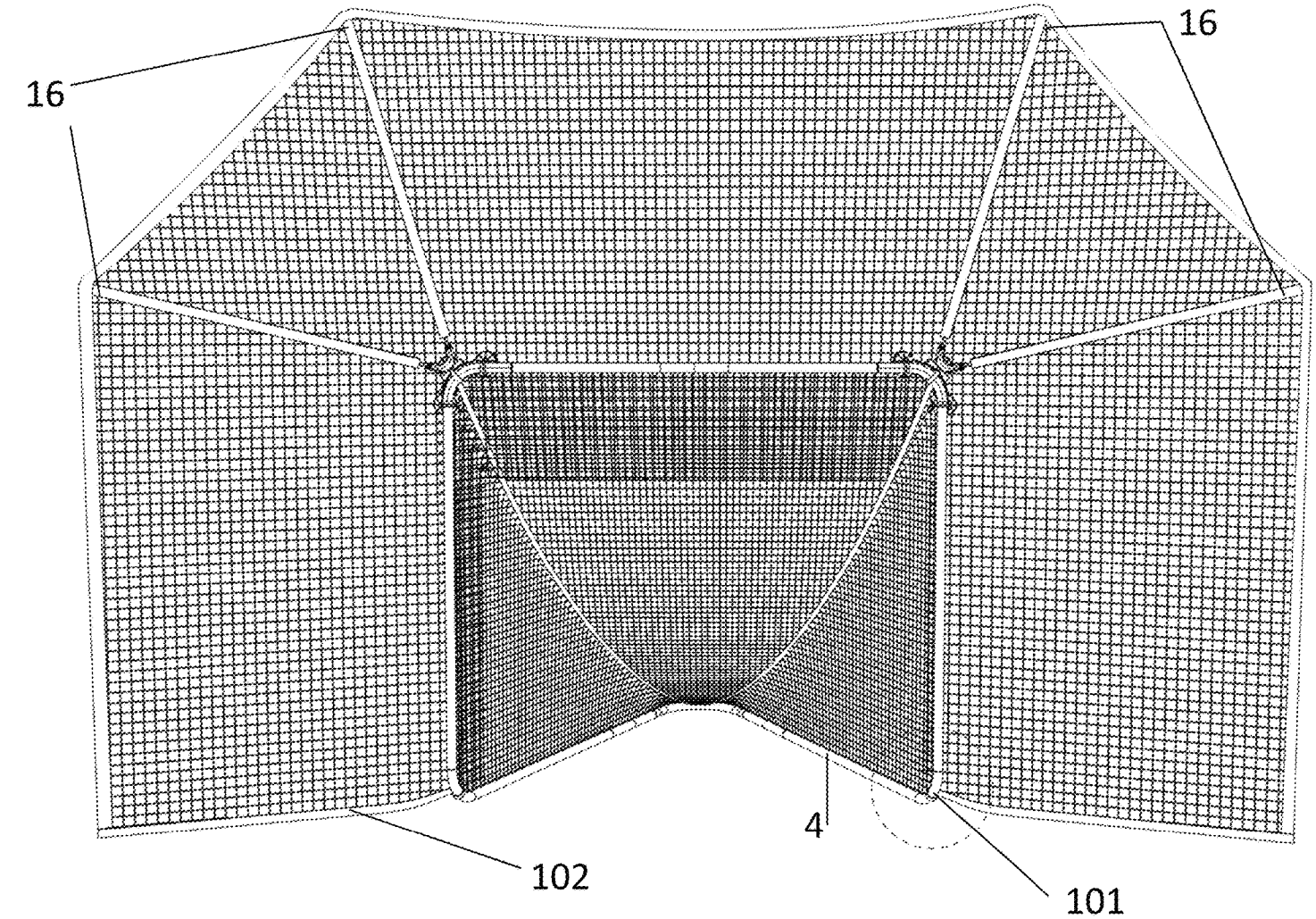
FIG. 30 illustrates a front view of the dual bracket mechanism mounted fully assembled with the net wing cross strap apparatus utilized.

FIG. 30 illustrates a front view of the dual bracket mechanism mounted fully assembled with the net wing cross strap apparatus 101 attaching the backstop net wing base 102 to the goal frame 4. Further, in one embodiment the net support poles, which may be covered by the net pole sleeves 16 are sewn to the backstop netting. And, this is the only point where in the netting is sewn in place and thus, the netting is free to move in all other areas. This prevents taring and shedding of the netting through overly rigid mounting and stress upon impact.

Figure 31:
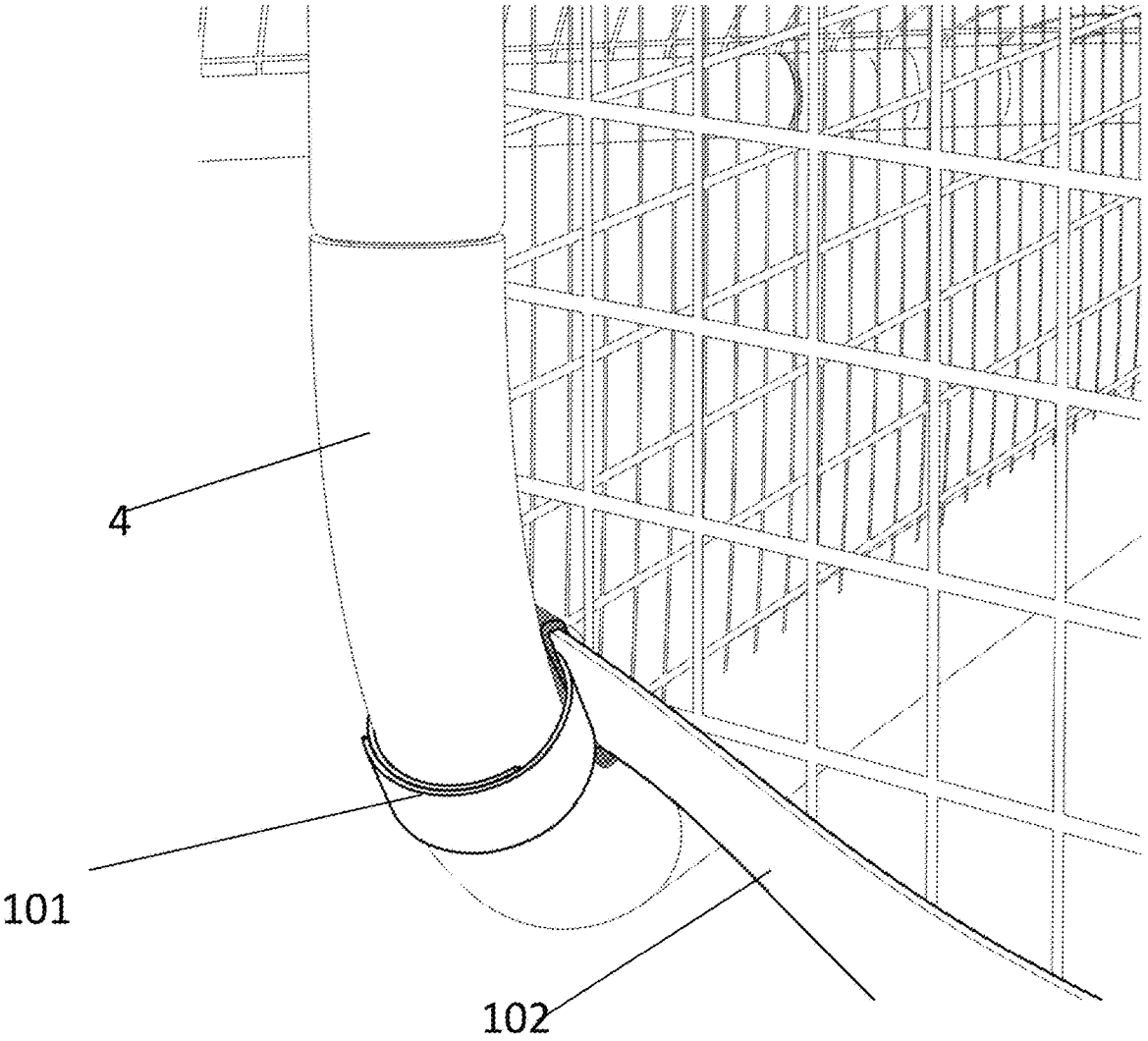
FIG. 31 illustrates an enlarged view of the net wing cross strap apparatus attached to both the backstop netting and the goal frame.

FIG. 31 shows an enlarged perspective view of the net wing cross strap 101 attaching the backstop net wing base 102 to the goal frame 4.

Figure 32:
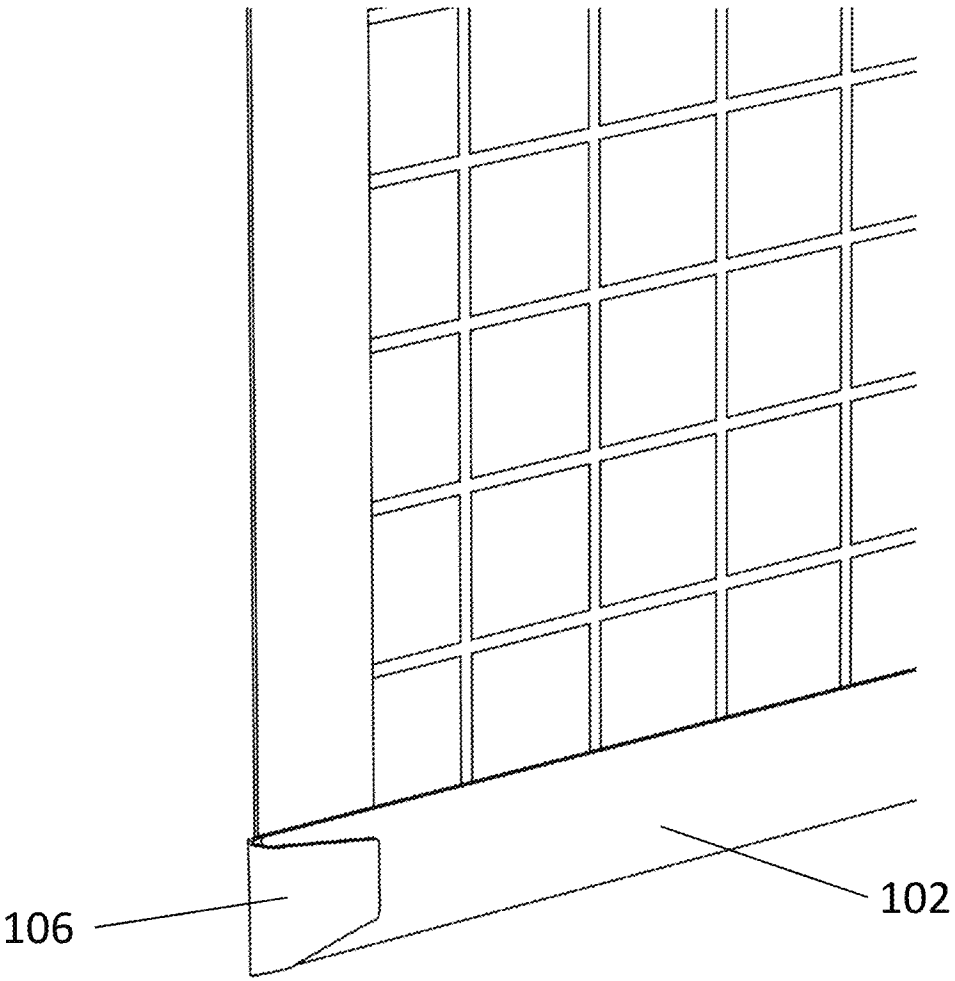
FIG. 32 illustrates an enlarged view of the Velcro pocket of the backstop netting in the closed position.

FIG. 32 illustrates an enlarged view of one embodiment of the Velcro® pocket 106 of the backstop net wing base 102. Here, the Velcro® pocket 106 is in the closed position.

Figure 33:
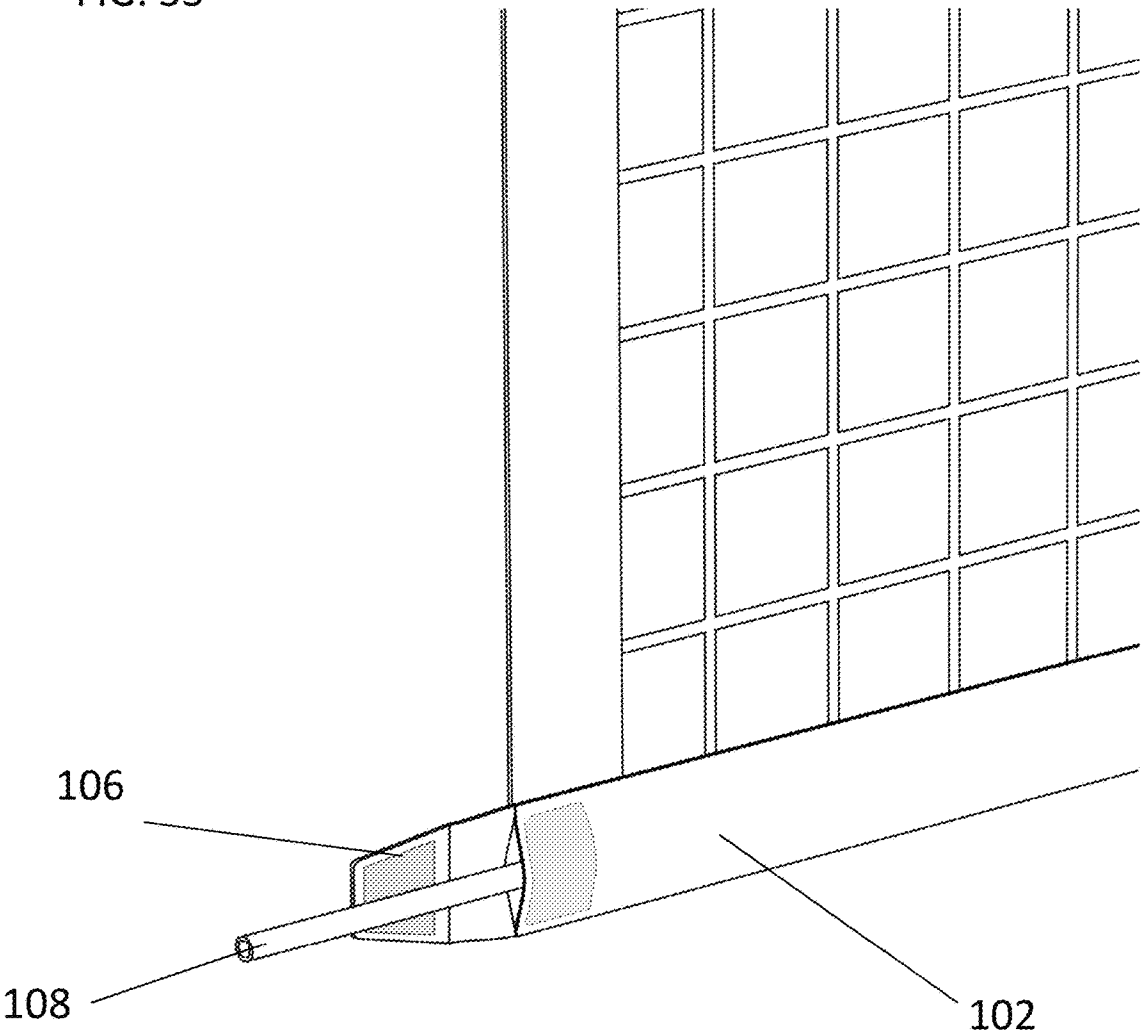
FIG. 33 illustrates an enlarged view of the Velcro pocket of the backstop netting in the open position.

FIG. 33 illustrates an enlarged view of one embodiment of the Velcro® pocket of the backstop net wing base. Here, the Velcro® pocket 106 is in the open position. Within the pocket 106 is folding net wing stiffener pole 108. The stiffener pole may be made of polymeric material, heavy duty plastic, or metal to weigh the net wing base 102 and hold it to the ground.

Figure 34:
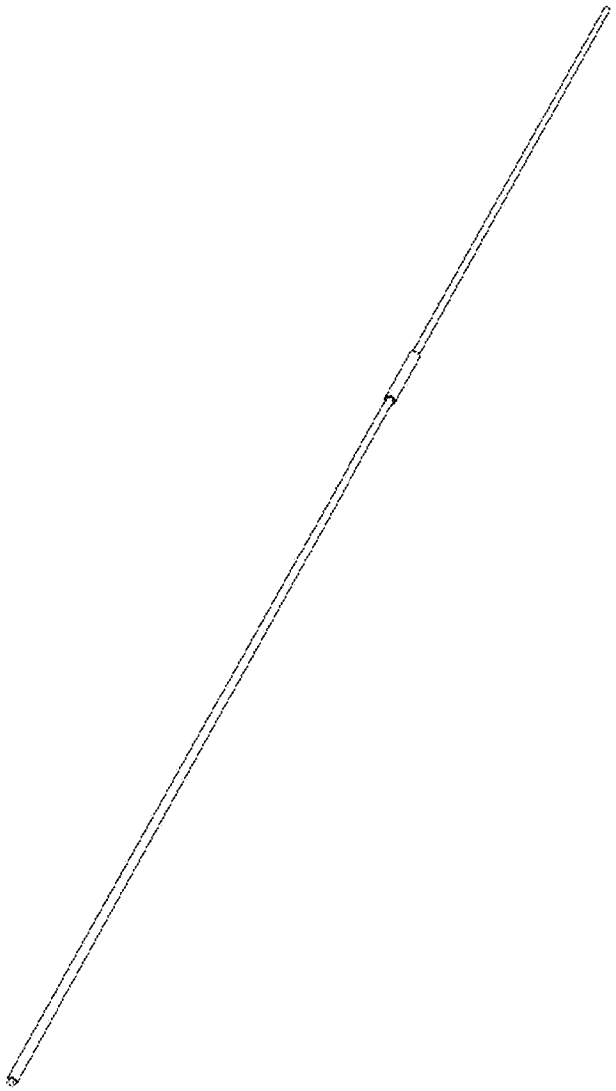
FIG. 34 illustrates a front view of the net wing pole assembly.

FIG. 34 illustrates a front view of one embodiment of the net wing pole 108.

Figure 35:
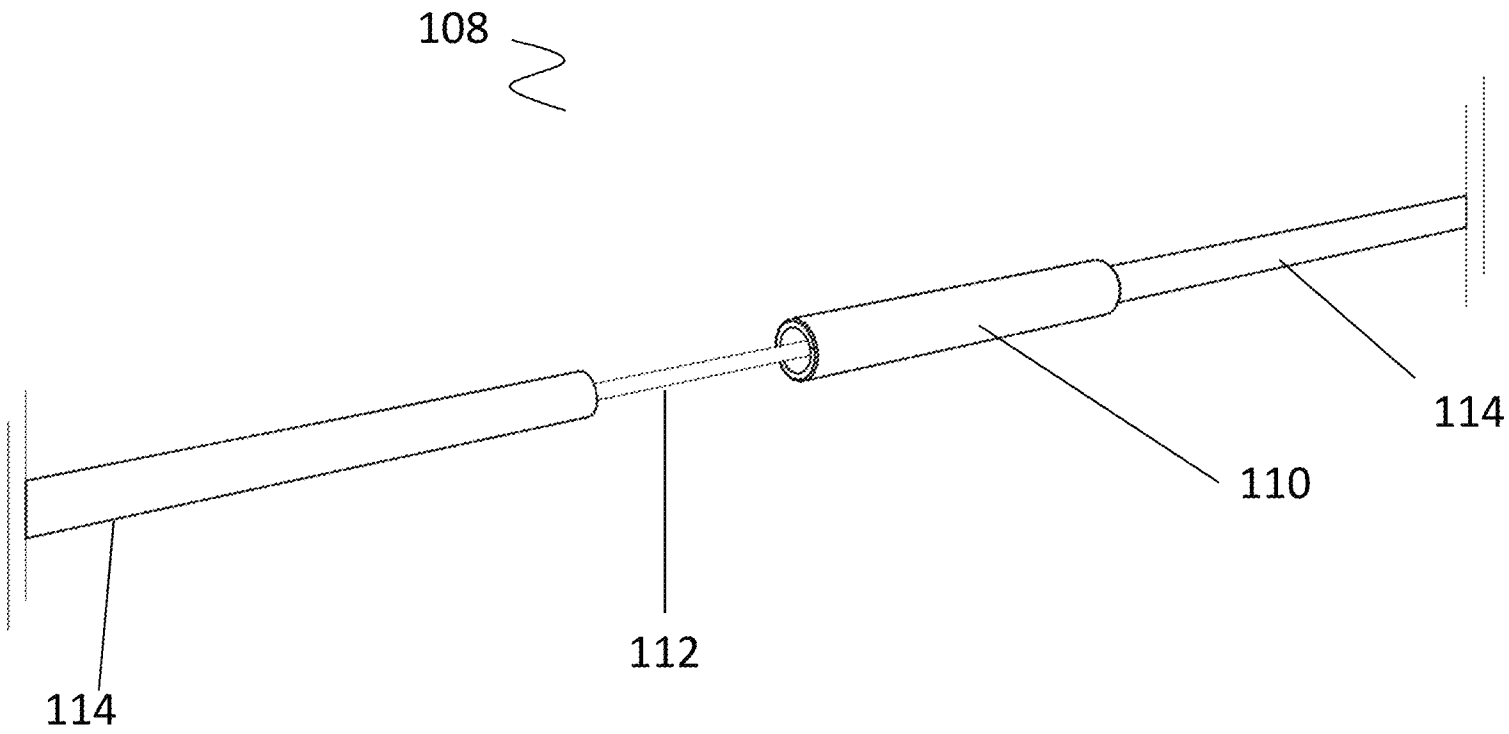
FIG. 35 illustrates an enlarged detailed view of the net wing pole assembly.

FIG. 35 illustrates an enlarged detailed view of the net wing pole assembly 108. In this embodiment, the net wing pole assembly 108 comprises of at least two impact resistant poles 114. Within the impact resistant poles runs an elastic cord 112. In between the two poles, there is a metal coupler 110. If more than two impact resistant poles are used for the overall assembly, there may be multiple metal couplers between one impact resistant pole and another. The metal coupler allows for the net wing pole assembly to be easily stored and maneuverable by allowing the impact resistant poles to be folded for storage.

Figure 36:
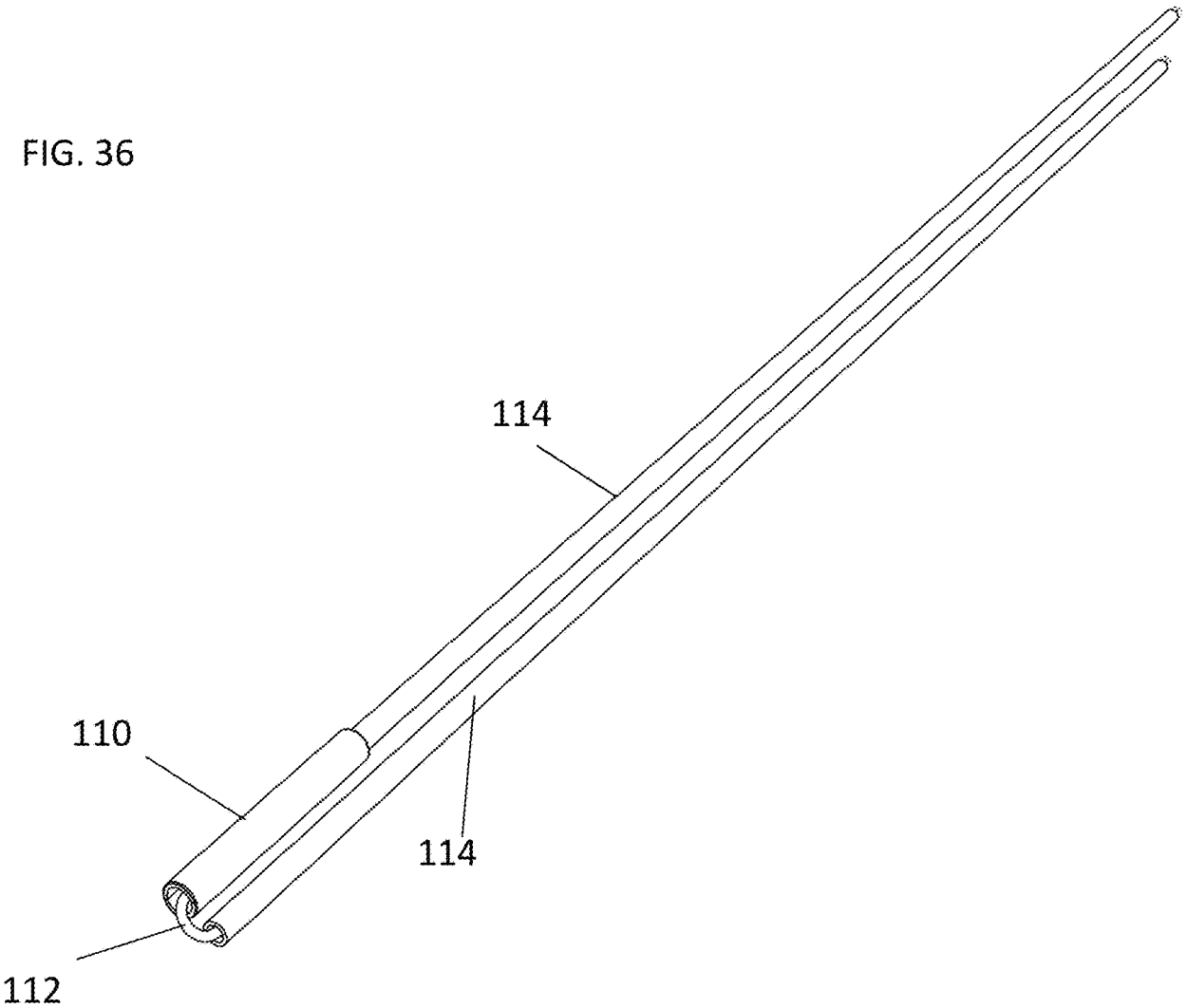
FIG. 36 illustrates a perspective view of the net wing pole in the folded assembly.

FIG. 36 illustrates an embodiment of the net pole assembly, wherein a metal coupler 110 divides the impact resistant poles 114, allowing the resistant poles to be folded in half. Running through the resistant poles and metal coupler is an elastic cord 112.

Figure 37:
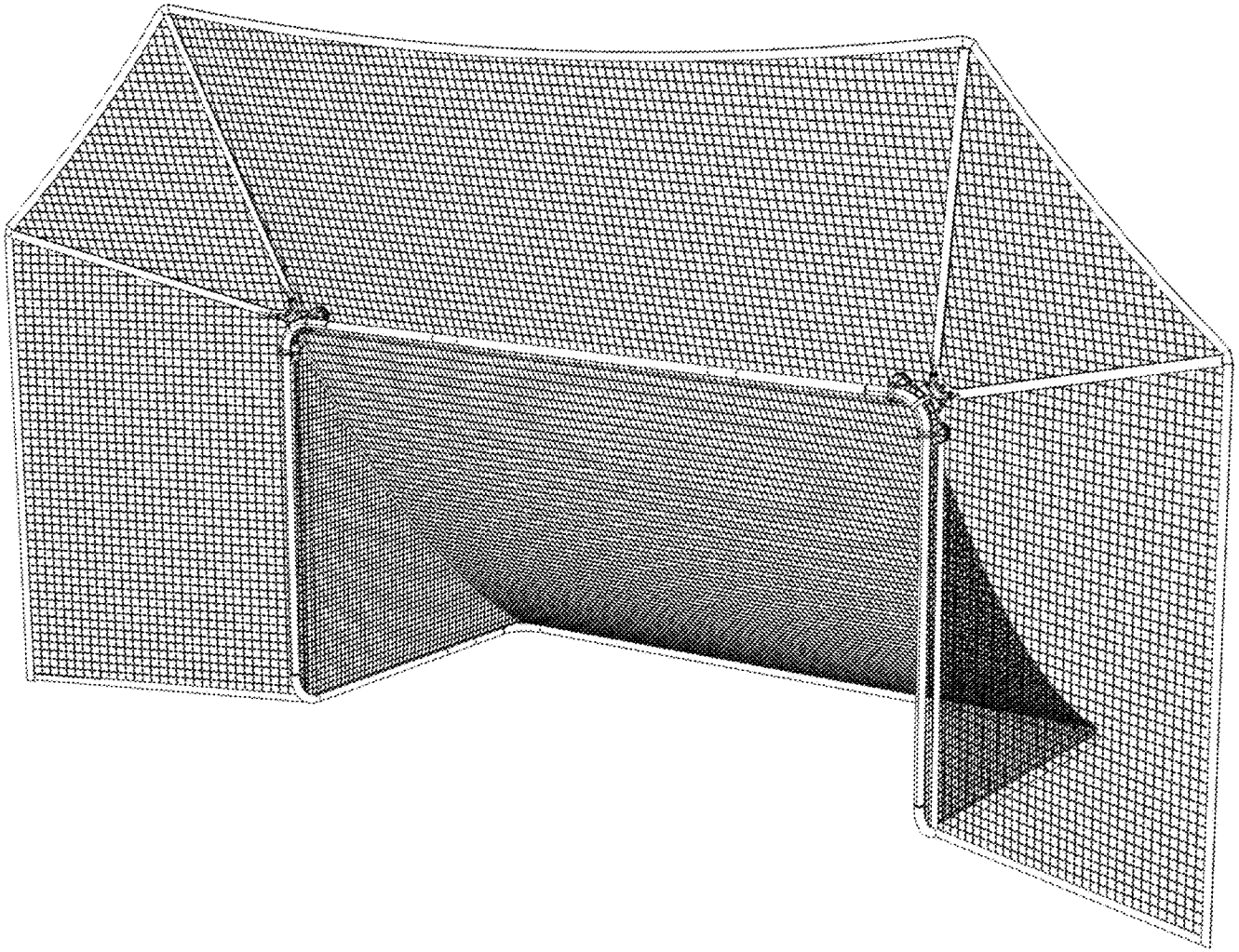
FIG. 37 illustrates an isometric view of the entire system as illustrated attached to a soccer goal.

FIG. 37 illustrates an isometric view of the entire system as illustrated attached to a soccer goal.

Figure 38:
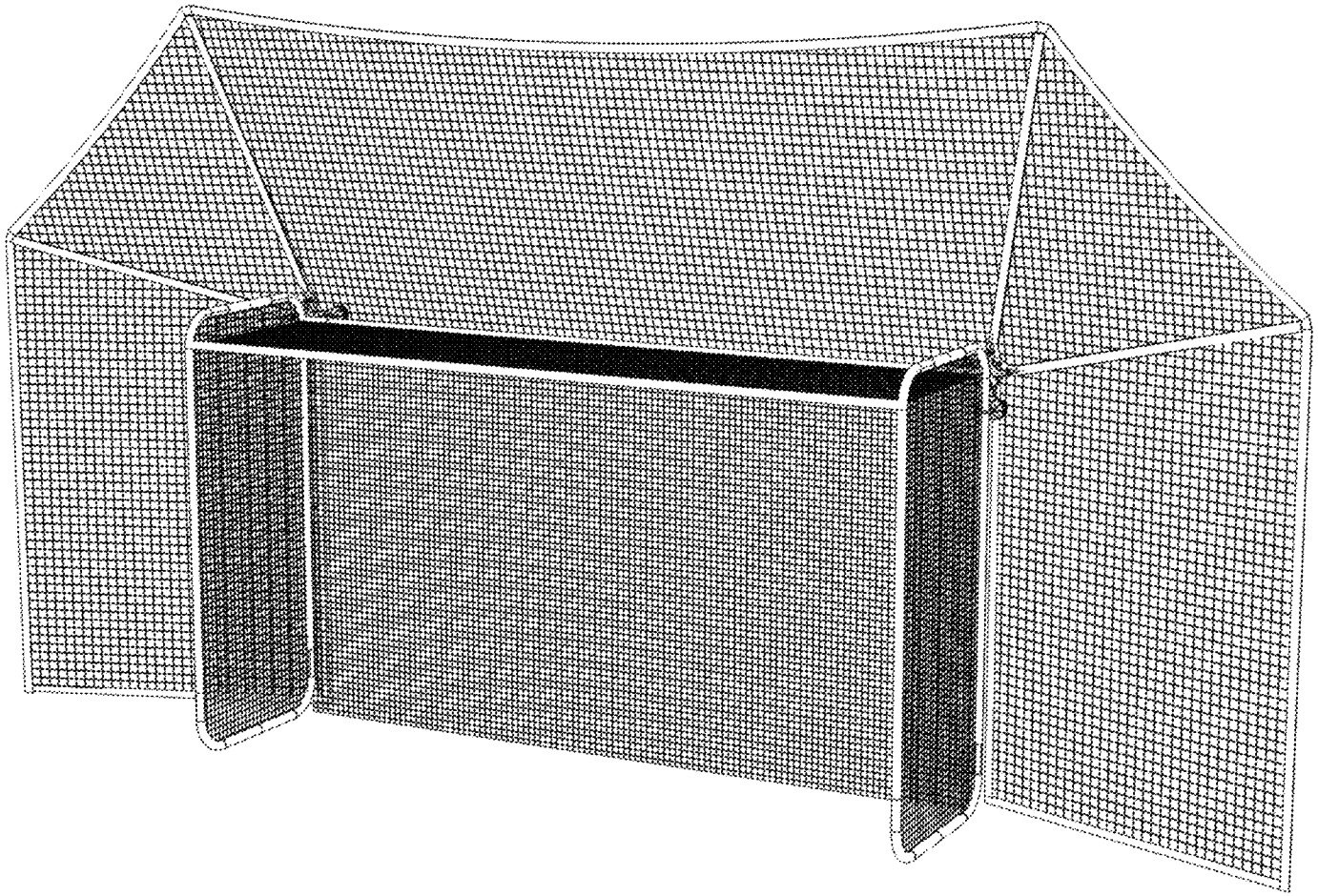
FIG. 38 illustrates an isometric view of the entire system as illustrated attached to a field hockey goal.

FIG. 38 illustrates an isometric view of the entire system as illustrated attached to a field hockey goal.

Figure 39:
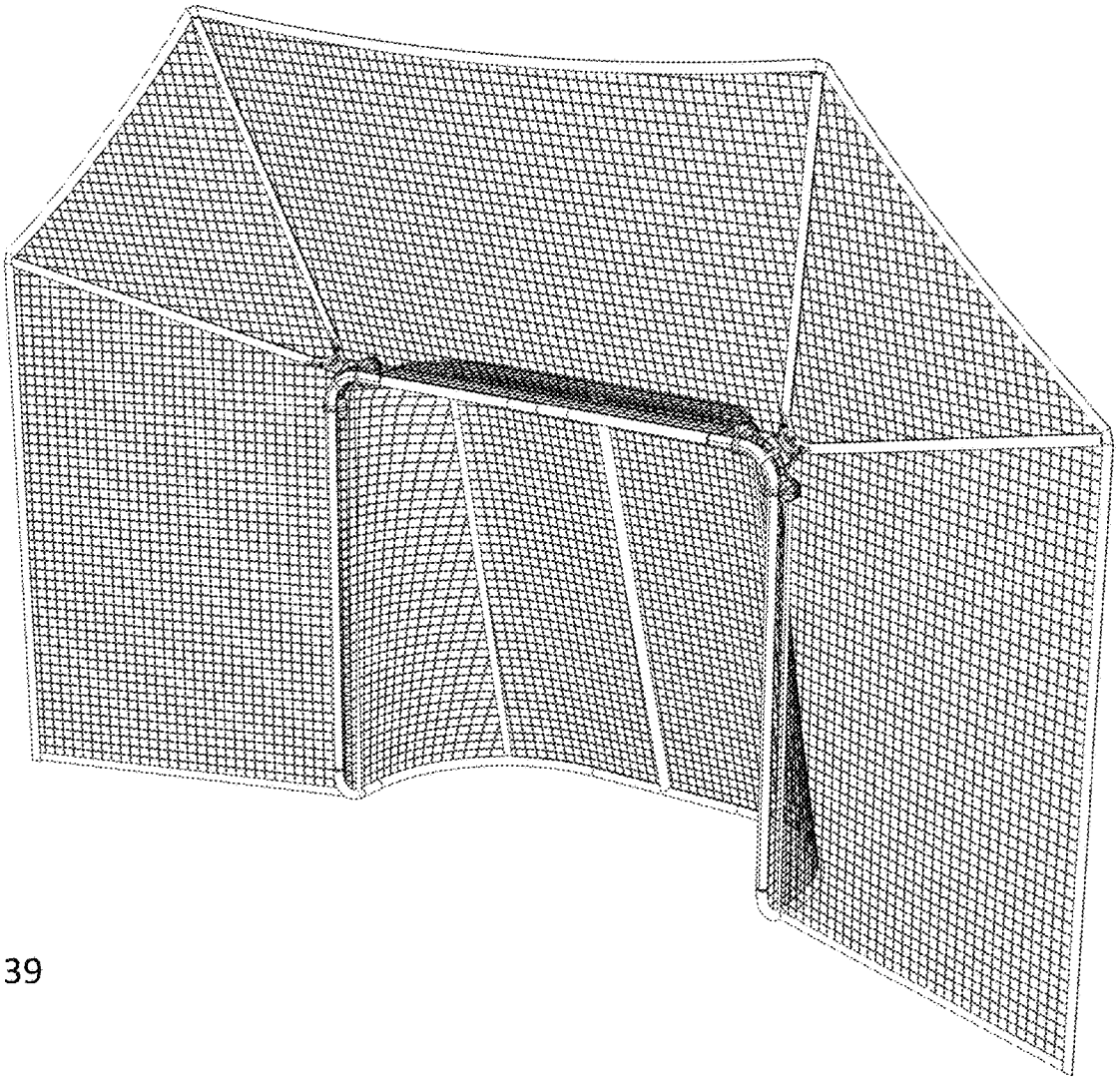
FIG. 39 illustrates an isometric view of the entire system as illustrated attached to a hockey goal.

Additionally, FIG. 39 illustrates an isometric view of the entire system as illustrated attached to a hockey goal.

Figure 40:
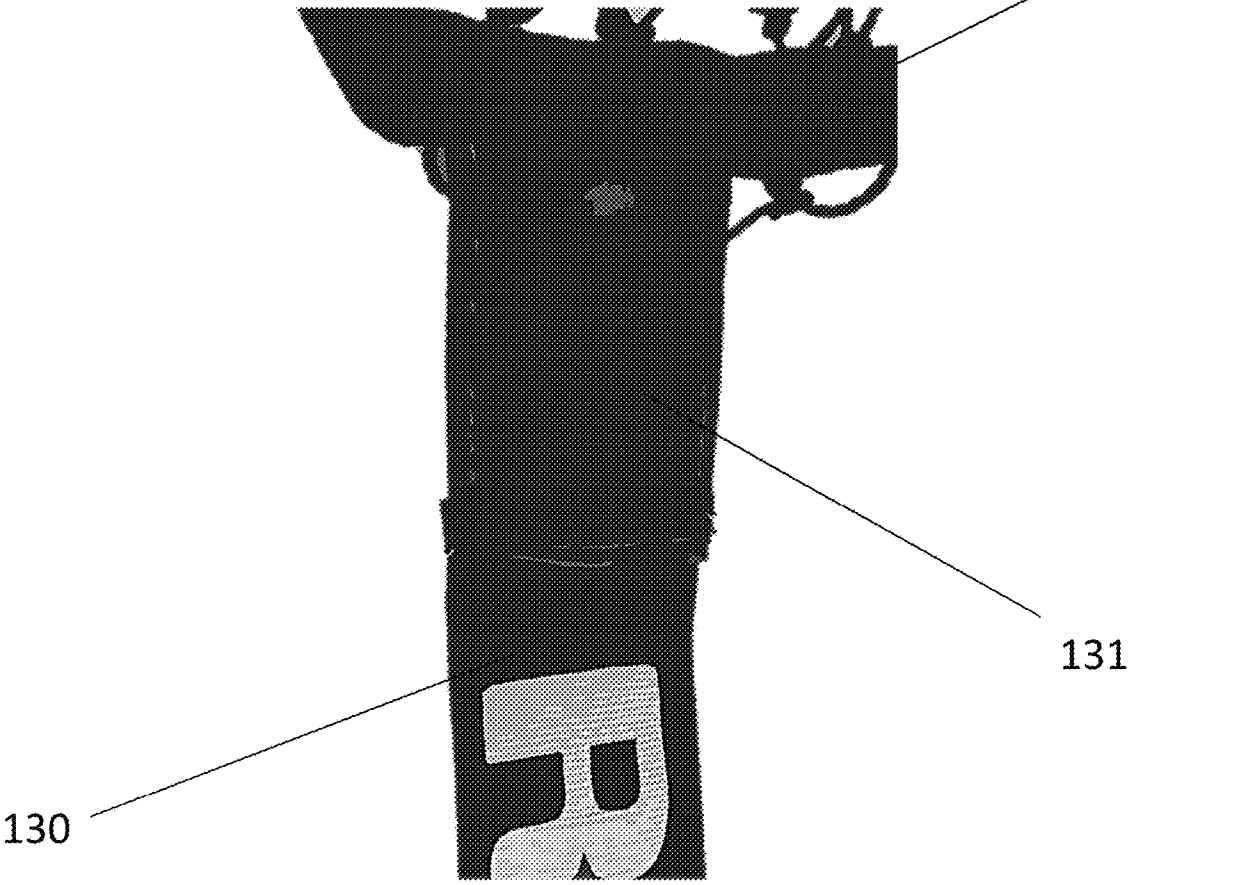
FIG. 40 illustrates a Net Edge Binding at the top of the Net Pole Sleeve and the reinforcement material and the singular point of attachment for the net.

FIG. 40 illustrates the Net Edge Binding at the top of the Net Pole Sleeve 130 and the reinforcement material utilized 131 therein. The Net Edge Binding 132 and stitching at the end of the Net Pole Sleeve hold the netting to the Net Pole Sleeves at four points. These four points are the only areas wherein the netting is sewn allowing the netting to swing free and absorb impact without tearing.

Figure 41:
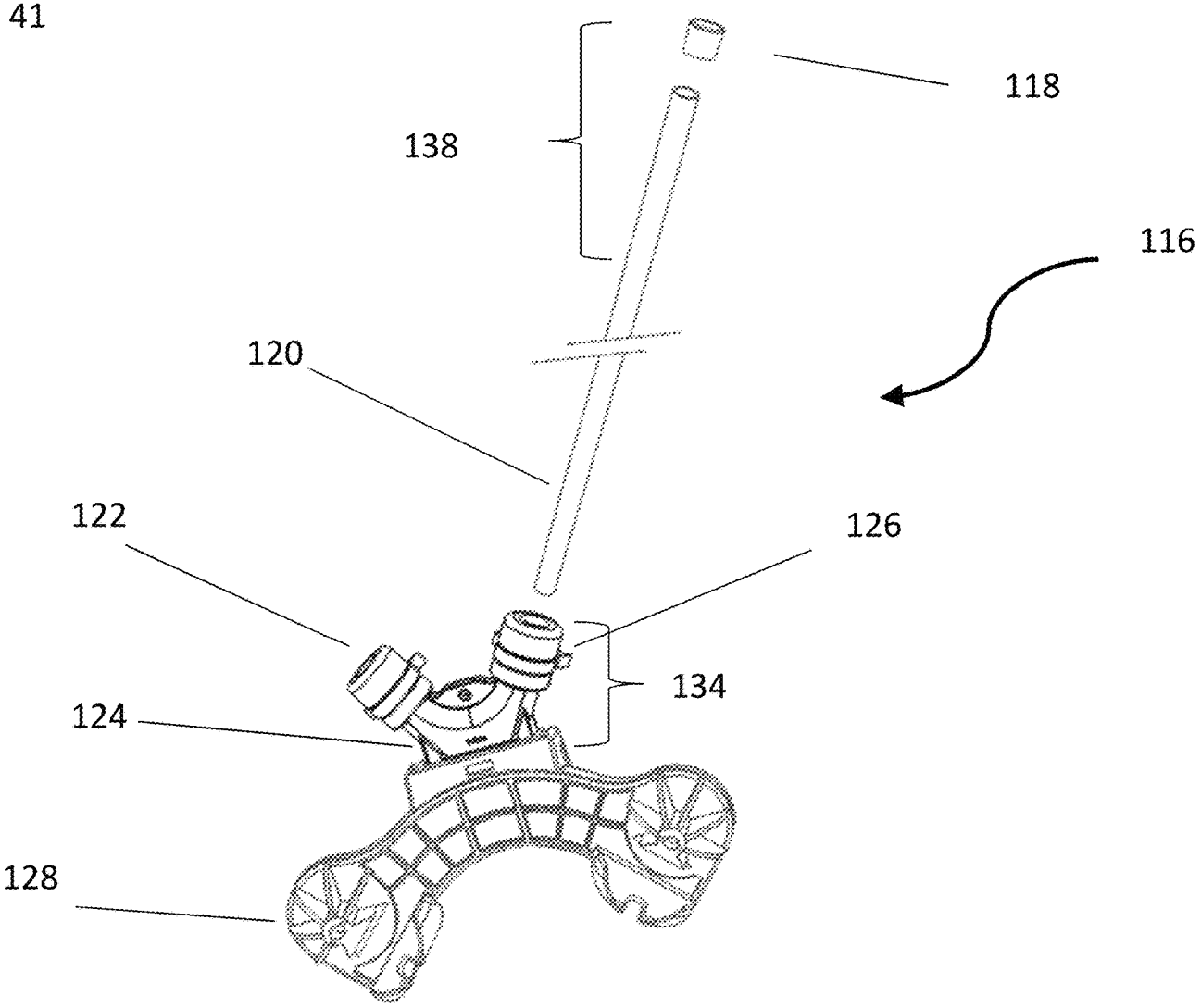
FIG. 41 illustrates an enlarged view of the Net Pole Insert Boot design consisting of the bracket mechanism, pivot hinge member, boot wraps and clamps, with an exploded component view of the net pole.

FIG. 41 illustrates one embodiment of the Net Pole Insert Boot design apparatus 134 comprising the pivot hinge member 124, at least two boot wraps 122, and at least two clamps 126. The New Pole Insert Boot design is in communication with the bracket mechanism 128. The net pole 138 is illustrated, comprising at least two portions 118, 120.

Figure 42:
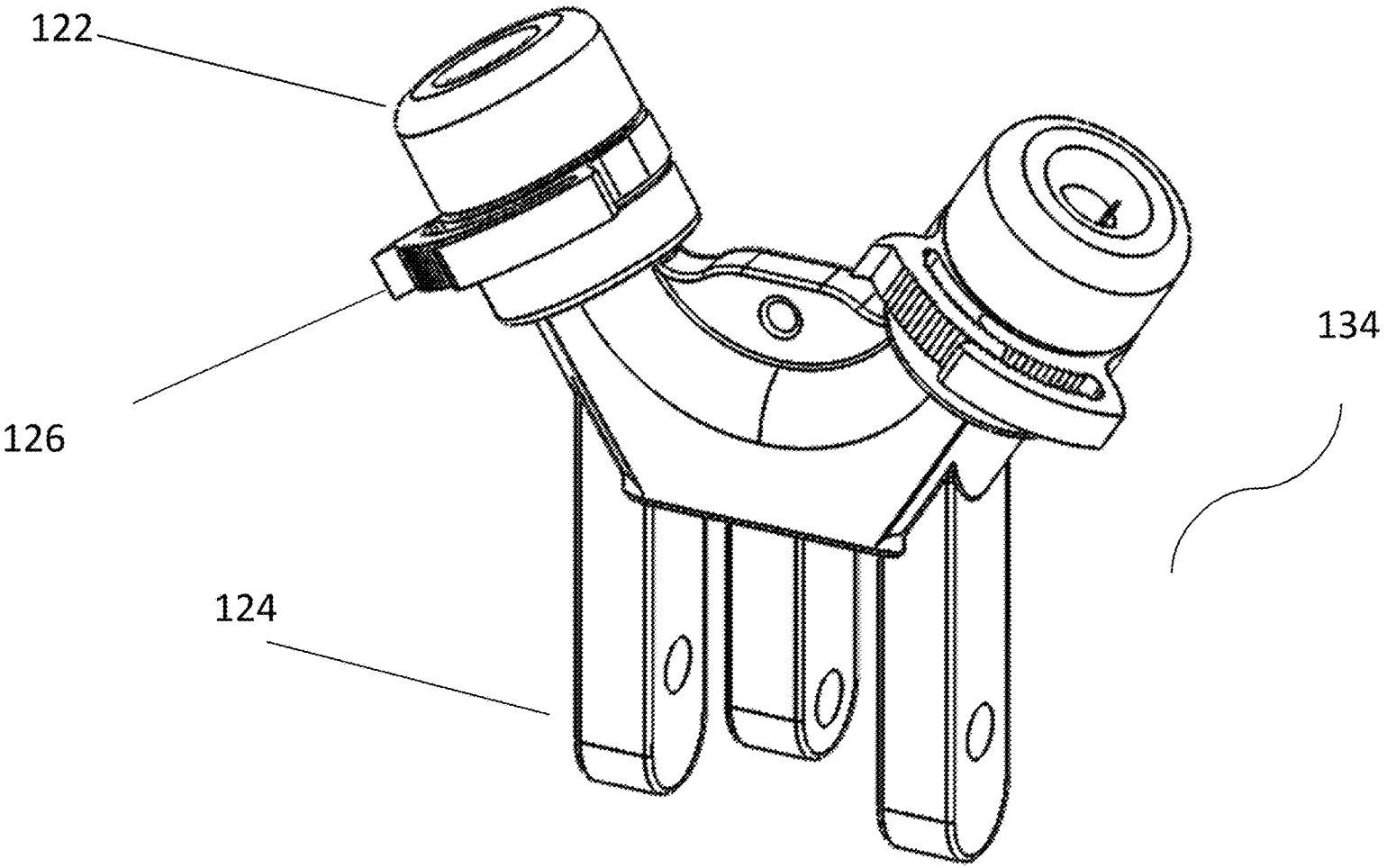
FIG. 42 illustrates an enlarged front section view of the pivot hinge member assembled with boot wraps and clamps in place.

FIG. 42 illustrates an enlarged front section view of the Net Pole Insert Boot design apparatus 134 comprising the pivot hinge member 124, boot wraps 122 and clamps 126. The boot wraps 122 are slideably and removably in communication with the pivot hinge member 124. The clamps 126 are slideably and removably in communication with the boot wraps 122.

Figure 43:
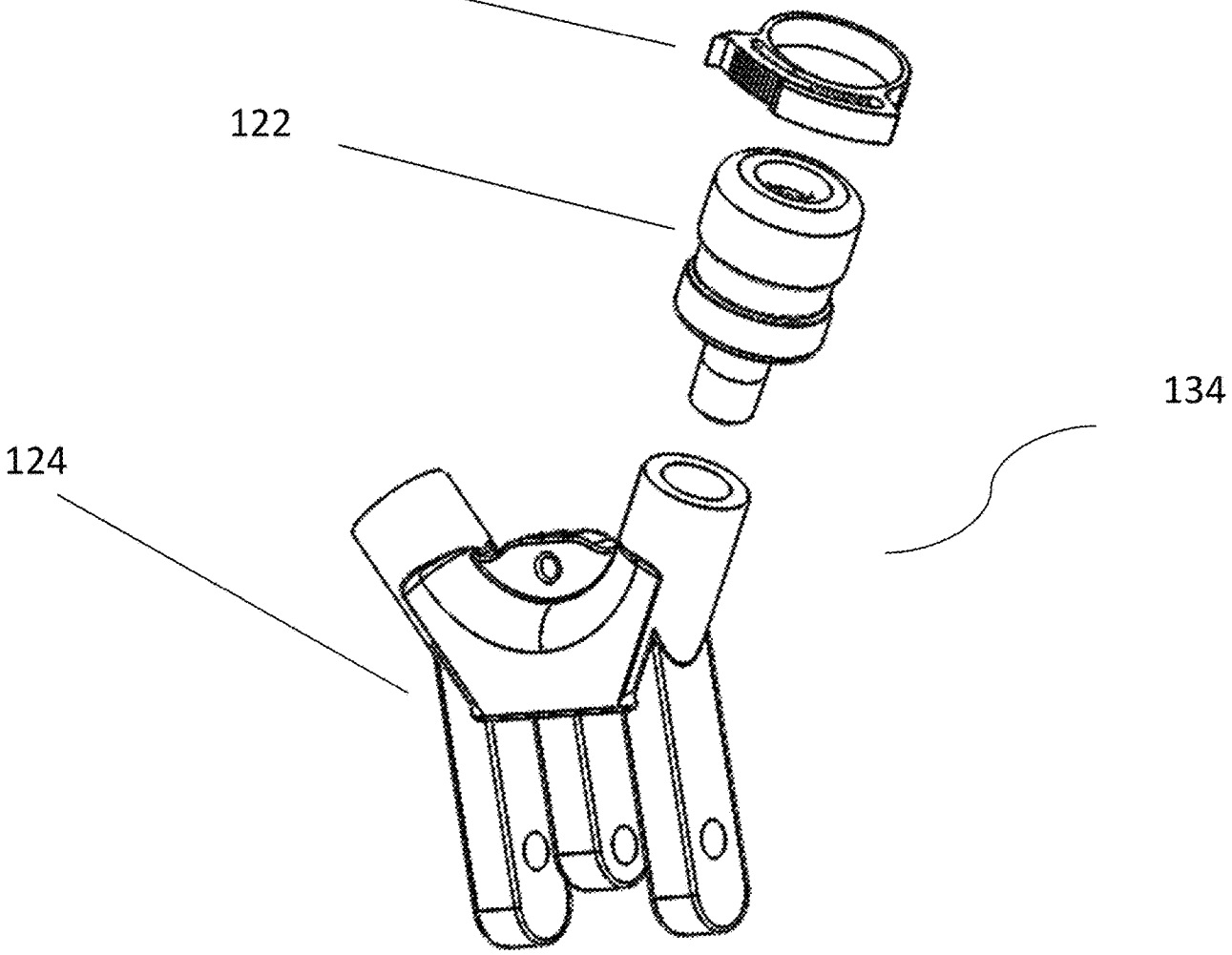
FIG. 43 illustrates an exploded view of the pivot hinge member, right boot wrap and right clamp.

FIG. 43 illustrates an exploded view of the bracket mechanism 128, consisting the pivot hinge member 124, right boot wrap 122 and right clamp 126.

Figure 44:
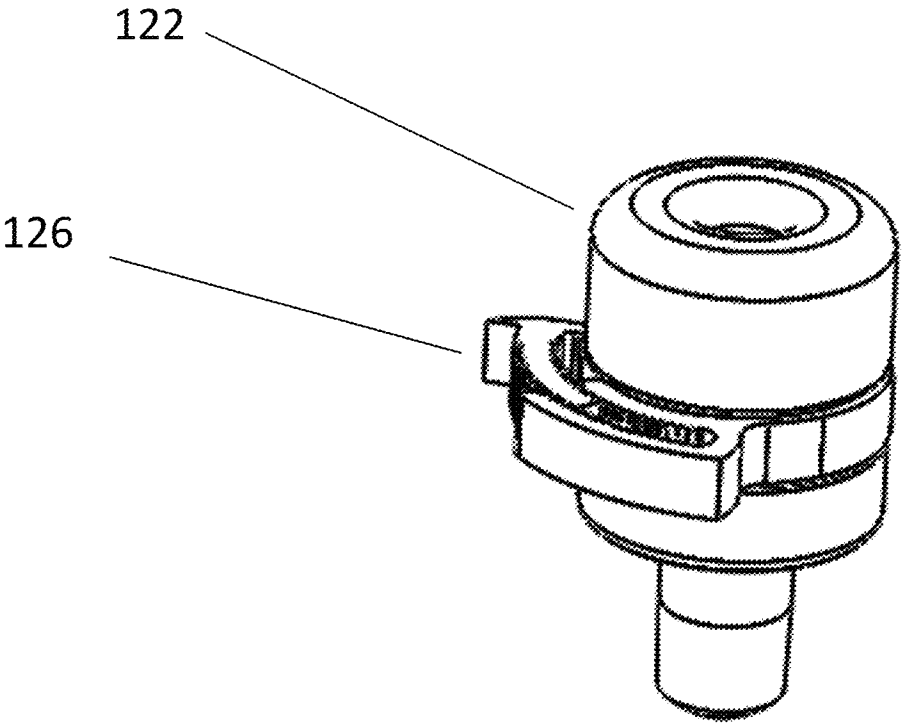
FIG. 44 illustrates a front view of the assembled boot wrap and clamp.

FIG. 44 illustrates a front view of the boot wrap 122 and clamp 126 assembly.

Figure 45A:
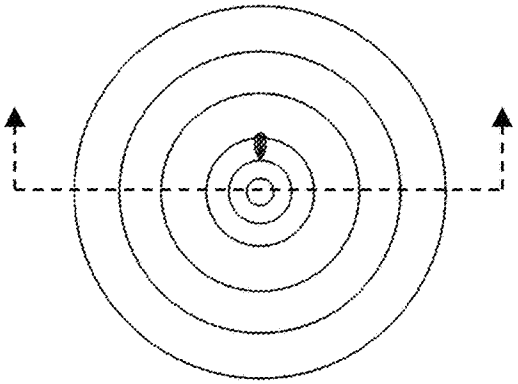
FIG. 45A illustrates a top view of the pivot hinge member and 45B illustrates a cross sectional view of the pivot hinge member revealing an internal air flow channel.
Figure 45B:
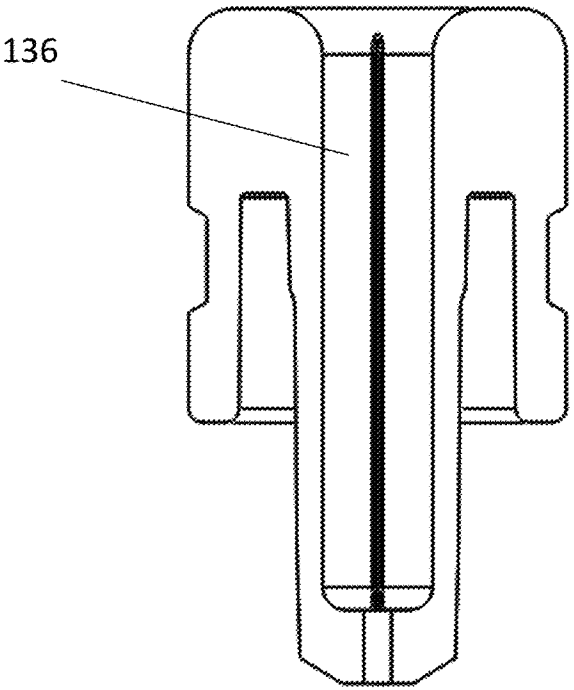

FIG. 45A illustrates a top view of the pivot hinge member 124. FIG. 45B illustrates a cross sectional view of the pivot hinge member 124 revealing an internal air flow channel 136.

Figure 46A:
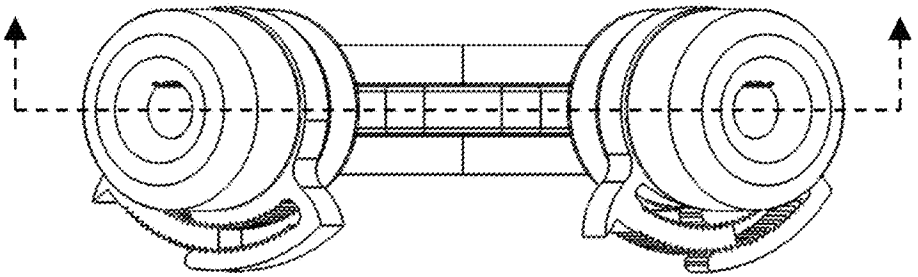
FIG. 46A illustrates a top view of the pivot hinge member with boot wraps and clamps and 46B illustrates a cross sectional view of the assembled pivot hinge member with boot wraps and clamps.
Figure 46B:
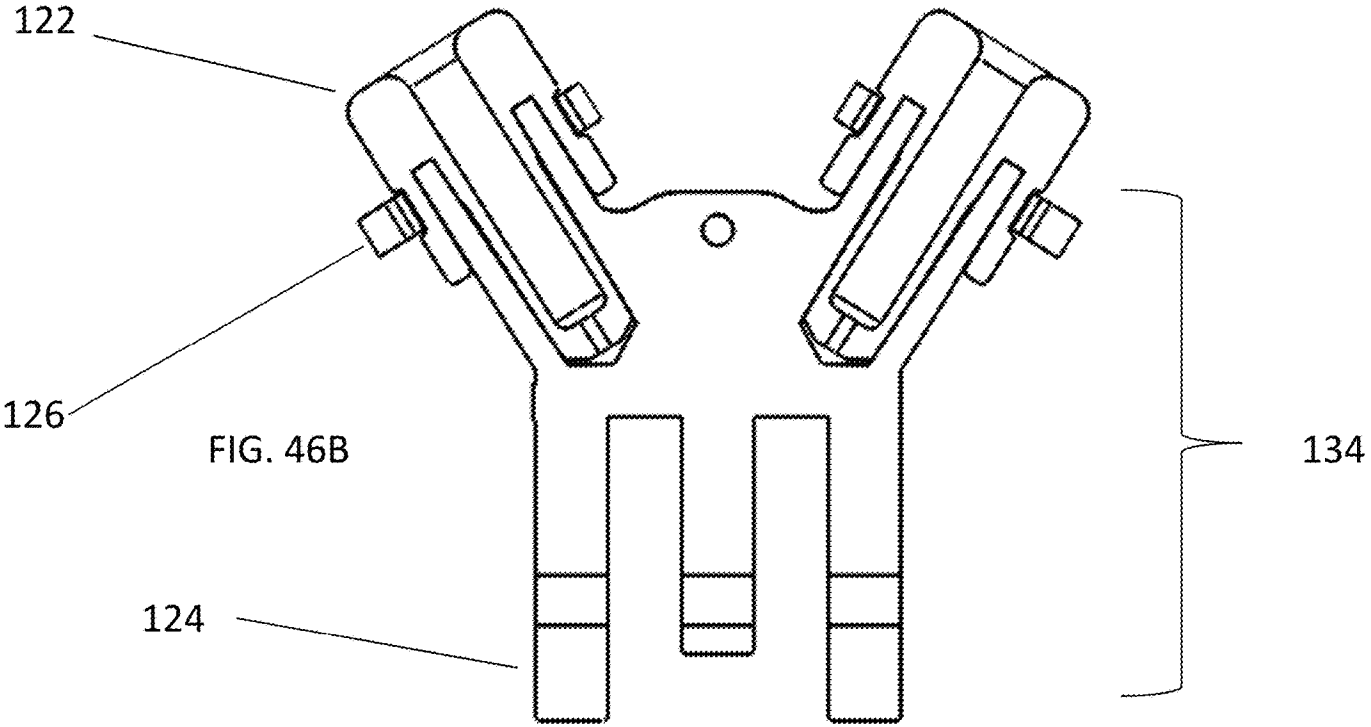

FIG. 46A illustrates a top view of the Net Pole Insert Boot design apparatus 134 comprising the pivot hinge member 124, boot wraps 122 and clamps 126. FIG. 46B illustrates a cross sectional view of the Net Pole Insert Boot design 134 comprising the pivot hinge member 124, boot wraps 122 and clamps 126.

Figure 47:
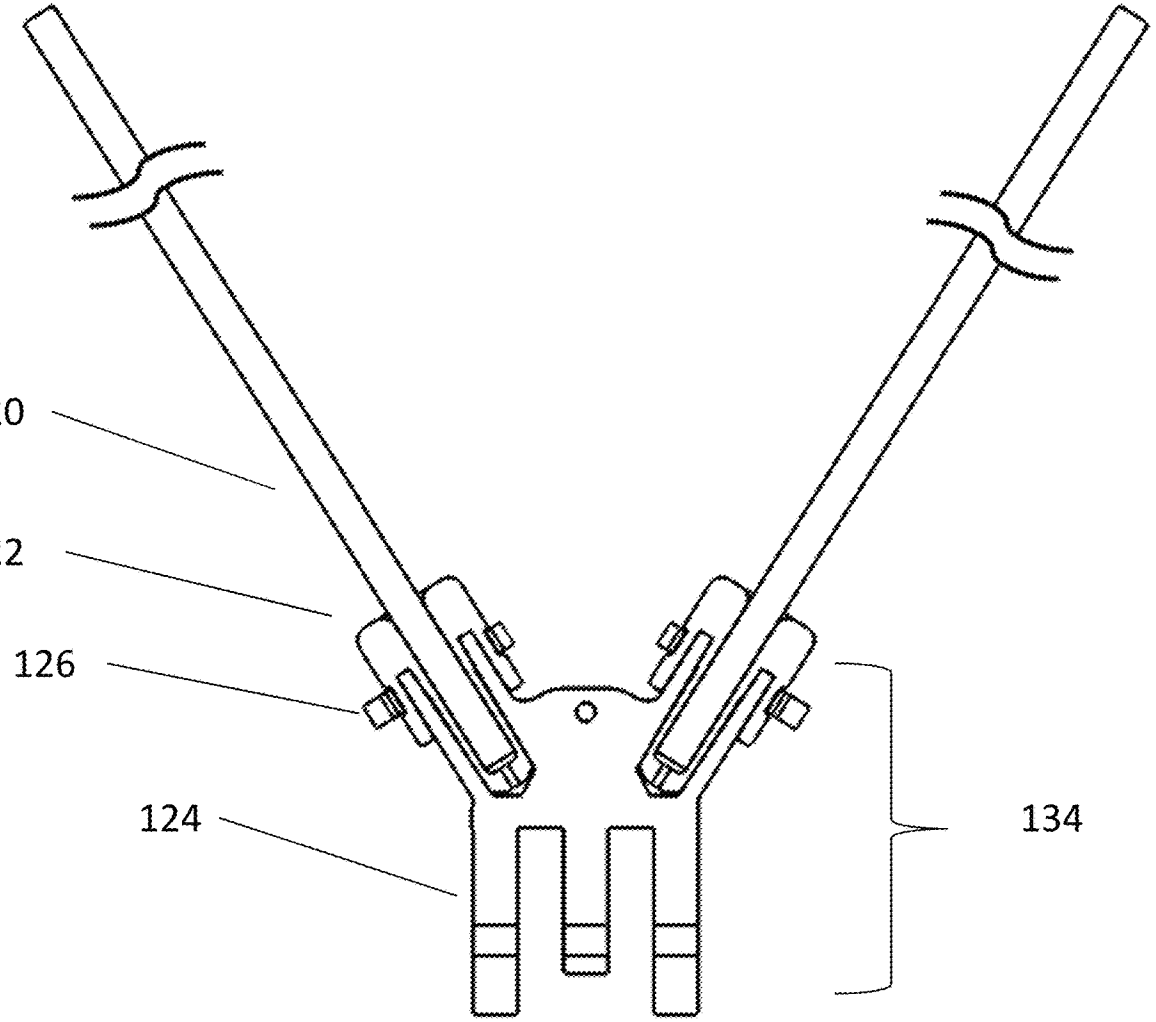
FIG. 47 illustrates a cross sectional view of the Net Pole Insert Boot design comprising of the pivot hinge member, boot wraps, clamps and net poles assembly; and, FIG. 48 illustrates a front view of the Net Pole Insert Boot design comprising of the pivot hinge member, boot wraps, clamps and net poles assembly.

FIG. 47 illustrates a cross sectional view of the Net Pole Insert Boot design apparatus 134 comprising of the pivot hinge member 124, boot wraps 122, clamps 126 and net poles 120 assembly. The net poles 120 are slideably and removably attached to the Net Pole Insert Boot design apparatus 134.

Figure 48:
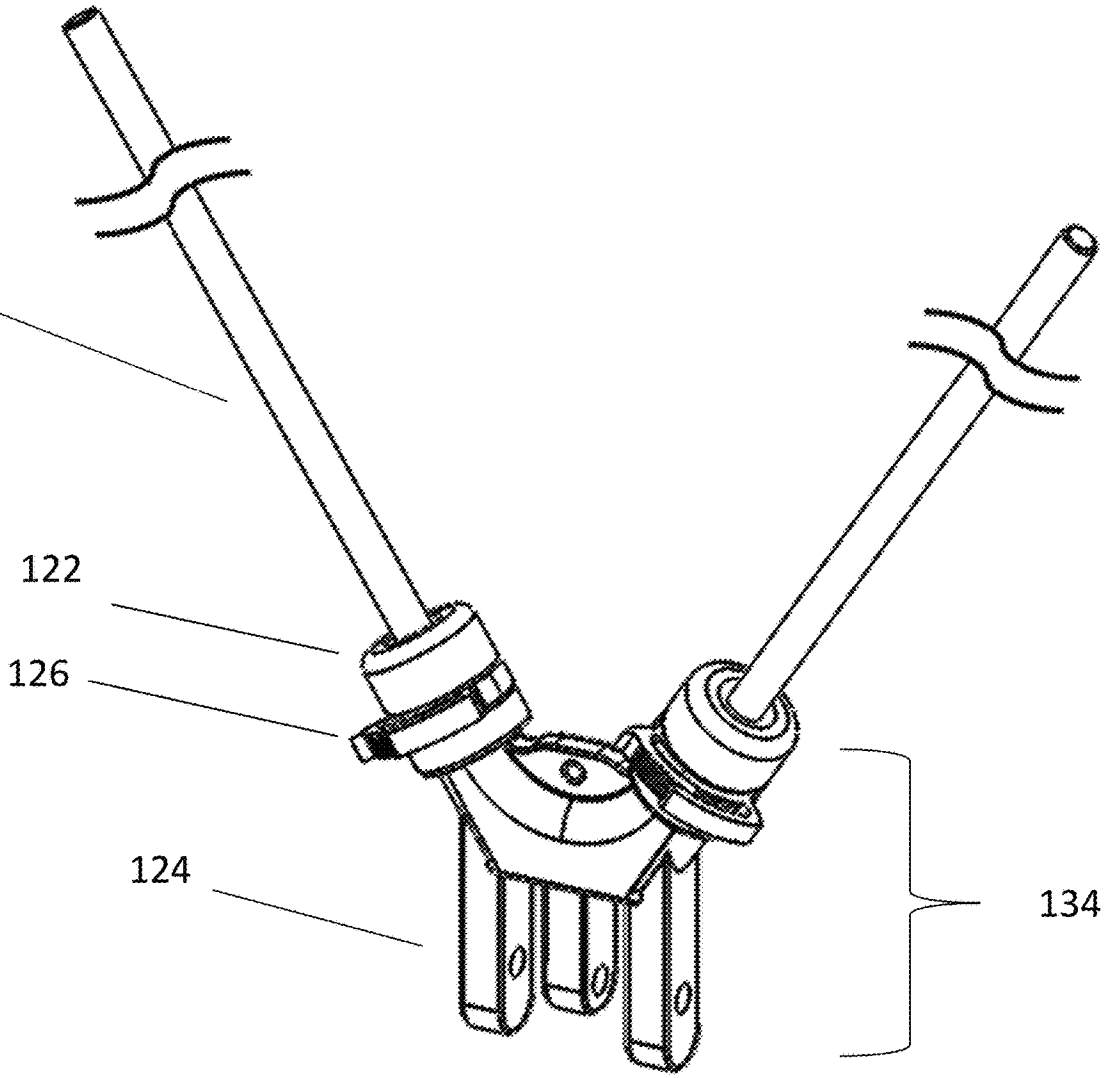

FIG. 48 illustrates a front view of the Net Pole Insert Boot design apparatus 134 comprising the pivot hinge member 124, boot wraps 122, clamps 126 and net pole apparatuses 120.

What is claimed:

1. A sports goal practice backstop for removable attachment to a sports goal comprising:

a removably attachable backstop net mechanism comprising a multiplicity of sections;

a first bracket assembly and a second bracket assembly wherein each of the first bracket assembly and the second bracket assembly comprise:

a first corner bracket mechanism comprising a clamp knob apparatus and a second corner bracket mechanism comprising a clamp knob apparatus; and, a first pivot hinge member and a second pivot hinge member comprising at least 180 degrees range in travel;

a corner bracket pocket that allows each pivot hinge member to rotate freely into a latched and an unlatched position;

a pivot axel, wherein the pivot axel runs through the pivot hinge member;

a pivot hinge locking mechanism to allow the pivot hinge member make contact with the corner bracket mechanism;

a pair of anti-rotation slots located on each corner bracket member to receive an anti-rotation strap;

a set of rib areas and pocket areas on each corner bracket mechanism to reduce weight and increase strength;

a pair of bolt clamps to secure each corner bracket mechanism to the sports goal practice backstop;

a first support structure and a second support structure, wherein the first support structure and the second support are removably attached to the first pivot hinge member and the second pivot hinge member; and, at least one counterweight mechanism;

wherein each corner bracket mechanism utilizes a v-shaped, self-centering geometry to deploy the sports goal practice backstop.

2. The sports goal practice backstop for removable attachment to a sports goal of claim 1 further comprising a first support structure sleeve and a second support structure sleeve, wherein the first support structure and the second support structure are in communication with the first support structure sleeve and a second support structure sleeve respectively.

3. The sports goal practice backstop for removable attachment to a sports goal of claim 1, wherein the first support structure and the second support structure are in communication with the removably attached backstop net mechanism.

4. The sports goal practice backstop for removable attachment to a sports goal of claim 1 further comprising a backstop net control strap in communication the first pivot hinge member and the second pivot hinge member.

5. The sports goal practice backstop for removable attachment to a sports goal of claim 1, wherein the first and second support structures further comprise at least one insert devices and at least one capping mechanism, wherein the insert devices are in communication with the pivot hinge member.

6. The sports goal practice backstop for removable attachment to a sports goal of claim 1 wherein the sports goal practice backstop requires no tools for assembly, installation and removal and wherein the size and orientation of the deployed sports goal practice backstop is substantially similar to a diameter of an actual goal crease and wherein the system requires no modification to the goal frame, no drilling of apertures and no mounting of secondary brackets.

7. The sports goal practice backstop for removable attachment to a sports goal of claim 6 wherein the sports goal practice backstop is rotatably attached to a net frame for storage behind the goal without removal from a goal frame.

8. The sports goal practice backstop for removable attachment to a sports goal of claim 6 wherein each corner bracket assembly is disposed to fit on either side of a net frame wherein no designated left or right corner bracket orientation is required.

9. The sports goal practice backstop for removable attachment to a sports goal of claim 6 wherein pivot hinge member is disposed to drop fit into place and securely lock and wherein no additional locking hardware and no tools are required.

10. The sports goal practice backstop for removable attachment to a sports goal of claim 6 wherein each corner bracket assembly is self-centering corner and disposed to find a center-line regardless of goal pipe diameters.

11. The sports goal practice backstop for removable attachment to a sports goal of claim 6 further comprising a bracket clearance channel wherein the bracket clearance channel is disposed to fit on standard and non-standard net frames.

12. The sports goal practice backstop for removable attachment to a sports goal of claim 8 wherein the pair of anti-rotation straps add a third point of contact to the goal frame to prevent each corner bracket assembly from rotating backwards during usage.

13. The sports goal practice backstop for removable attachment to a sports goal of claim 8 further comprising a set of net control straps which retain and guide the removably attachable backstop net mechanism during the process of storing or folding the backstop behind the goal.

14. The sports goal practice backstop for removable attachment to a sports goal of claim 6 further comprising a net wing pocket and weight bar member system wherein the net wing pocket communicates with the weight bar such that the net wing pocket and weight bar member system is disposed to retrain the sports goal practice backstop from movement during use and wherein the net wing pocket and the weight bar member system further comprise a stiffener bar member to prevent the net wing pocket from buckling during use.

15. The sports goal practice backstop for removable attachment to a sports goal of claim 6 further wherein the removably attachable backstop net mechanism is sewn only at a set of four top points of a set of net poles allowing the netting to free float absorbing impact and providing less chance of the ball tearing through the netting, wherein the net poles are fixed in place; and, a shock absorbing polymer net pole insert design comprising a set of net pole inserts comprising a polymer material, wherein the set of net pole inserts comprise a set of ribs to allow the net poles to better absorb and disperse impact energy when struck by a ball.

16. The sports goal practice backstop for removable attachment to a sports goal of claim 8 further comprising a net wing cross strap and a net wing base wherein the net wing cross strap attaches the net wing base to the goal frame to better control the net wing motion.

17. The sports goal practice backstop for removable attachment to a sports goal of claim 8 further comprising:

a set of reinforced net pole sleeve ends comprising a reinforcement material wherein the reinforcement material prevents the net poles from tearing through the net sleeves; and, a set of clamp knobs wherein the set of clamp knobs are designed to be larger than the set of netting openings in order to prevent the set of clamp knobs from catching in the netting which would prevent proper backstop operation.

* * * * *